US011542575B2

(12) United States Patent
Adam et al.

(10) Patent No.: US 11,542,575 B2
(45) Date of Patent: Jan. 3, 2023

(54) NICKEL-BASED ALLOY EMBODIMENTS AND METHOD OF MAKING AND USING THE SAME

(71) Applicant: Etikrom A.S., Elazig (TR)

(72) Inventors: Benjamin Adam, Portland, OR (US); Julie Tucker, Corvallis, OR (US)

(73) Assignee: Etikrom A.S., Elazig (TR)

( * ) Notice: Subject to any disclaimer, the term of this patent is extended or adjusted under 35 U.S.C. 154(b) by 0 days.

(21) Appl. No.: 17/053,699

(22) PCT Filed: May 10, 2019

(86) PCT No.: PCT/US2019/031844
§ 371 (c)(1),
(2) Date: Nov. 6, 2020

(87) PCT Pub. No.: WO2019/217905
PCT Pub. Date: Nov. 14, 2019

(65) Prior Publication Data

US 2021/0214821 A1 Jul. 15, 2021

Related U.S. Application Data

(60) Provisional application No. 62/670,264, filed on May 11, 2018.

(51) Int. Cl.

| | |
|---|---|
| ***C22F 1/10*** | (2006.01) |
| ***C22C 19/05*** | (2006.01) |
| ***C22C 1/02*** | (2006.01) |

(52) U.S. Cl.
CPC ..... *C22C 19/056* (2013.01); *C22C 1/023* (2013.01); *C22C 19/055* (2013.01); *C22F 1/10* (2013.01)

(58) Field of Classification Search
CPC ..... C22F 1/10; C22C 19/05
See application file for complete search history.

(56) References Cited

U.S. PATENT DOCUMENTS

| | | | | |
|---|---|---|---|---|
| 6,258,317 | B1 | 7/2001 | Smith et al. | |
| 6,280,540 | B1 | 8/2001 | Crook | |
| 2003/0091459 | A1* | 5/2003 | Harris | C22C 19/057 420/444 |
| 2005/0158203 | A1 | 7/2005 | Sugahara | |
| 2009/0257908 | A1 | 10/2009 | Baker et al. | |
| 2009/0280024 | A1 | 11/2009 | Yamamura et al. | |
| 2009/0321405 | A1 | 12/2009 | Baker et al. | |
| 2021/0207247 | A1 | 7/2021 | Adam et al. | |

FOREIGN PATENT DOCUMENTS

| | | | |
|---|---|---|---|
| EP | 3109331 | A1 | 12/2016 |
| JP | S61236612 | A | 10/1986 |
| KR | 101836713 | B1 | 3/2018 |

OTHER PUBLICATIONS

Christ, H-J., S-Y. Chang, and U. Krupp. "Thermodynamic characteristics and numerical modeling of internal nitridation of nickel base alloys." Materials and Corrosion 54.11 (2003): 887-895.*

Kim, Jin Ho, Authorized Officer, Korean Intellectual Property Office, "International Search Report" in connection with related International Patent Application No. PCT/US2019/031844, dated Aug. 12, 2019, 4 pgs.

Rebak, Raul B., "Effects of Metallurgical Variables on the Corrosion of High-Nickel Alloys", ASM Handbook, vol. 13A: Corrosion: Fundamentals, Testing, and Protection, 2003, pp. 279-286.

Kim, Jin Ho, Authorized Officer, Korean Intellectual Property Office, "International Search Report" in connection with related International Application No. PCT/US2019/031844, dated Aug. 12, 2019, 7 pgs.

* cited by examiner

*Primary Examiner* — Jessee R Roe
(74) *Attorney, Agent, or Firm* — Kolisch Hartwell, P.C.

(57) ABSTRACT

Disclosed herein are embodiments of a nickel-based alloy. In particular embodiments, the nickel-based alloy is configured for use in applications involving supercritical fluids. The disclosed nickel-based alloy embodiments are highly resistant to corrosion and exhibit high stability and thus are suited for use in vessels, boilers, piping, and other receptacles that contain or are used with supercritical fluids. Method embodiments of making the nickel-based alloy also are disclosed.

8 Claims, 24 Drawing Sheets

NICKEL-BASED ALLOY EMBODIMENTS AND METHOD OF MAKING AND USING THE SAME

CROSS REFERENCE TO RELATED APPLICATIONS

This application claims priority under 35 U.S.C. § 371 to PCT Patent Application Serial No. PCT/US2019/031844, filed May 10, 2019, which application claims the benefit of U.S. provisional patent application No. 62/670,264, filed May 11, 2018, both of which are incorporated herein by reference in their entirety.

FIELD

The present disclosure concerns nickel-based alloy embodiments that are capable of serving as vessels for supercritical fluids, as well as methods of making such alloy embodiments.

BACKGROUND

Fluids become supercritical fluids under conditions where the fluid's pressure and temperature are both greater than the respective critical value, at which point the fluid cannot be categorized as either a gas or liquid. An emerging application for supercritical fluids, including supercritical $CO_2$ ($sCO_2$), is power production cycles, which may serve as alternative energy conversion systems to classical steam cycles. Supercritical fluid cycles improve efficiencies, reduce emissions, and require fewer, smaller energy conversion components and less water for cooling. While the use of supercritical fluids has clear benefits, their use does have drawbacks as they often are highly corrosive and can corrode vessels, boilers, piping, and other receptacles that contain such supercritical fluids.

Stainless steels and certain nickel-chromium-based alloys may be suitable materials for use in $sCO_2$ power production cycles; however, many of these alloys do not exhibit sufficient strength and/or corrosion resistance in such applications and thus are not suitable alternatives for such technologies. A need exists in the art for alloys having improved strength and corrosion resistance and methods that can be used to identify and make such alloys.

SUMMARY

Disclosed herein are embodiments of an alloy capable of being used with supercritical fluids. In some embodiments, the alloy is a nickel-based alloy. Nickel-based alloy embodiments can comprise nickel, chromium, cobalt, aluminum, and carbon. In some embodiments, the nickel-based alloy can further comprise amounts of niobium, tungsten, molybdenum, titanium, iron, and boron. Amounts of components in the alloy are disclosed herein, along with representative embodiments.

Also disclosed herein are methods for making nickel-based alloy embodiments and for designing nickel-based alloys. In some embodiments, the method of designing a nickel-based alloy can comprise determining a set of properties for the alloy; determining an initial composition of constituent alloy elements of the alloy; calculating the set of properties for the initial composition of the alloy using thermodynamic and kinetic analysis; and fabricating the alloy.

The foregoing and other objects and features of the present disclosure will become more apparent from the following detailed description, which proceeds with reference to the accompanying figures.

BRIEF DESCRIPTION OF THE DRAWINGS

FIG. 10A is a coarsening plot for the γ'-phase of Alloy 1A and FIG. 10B is a time-temperature-transformation (TTT) diagram for Alloy 1A.

DETAILED DESCRIPTION

I. Overview of Terms

Figure 1:
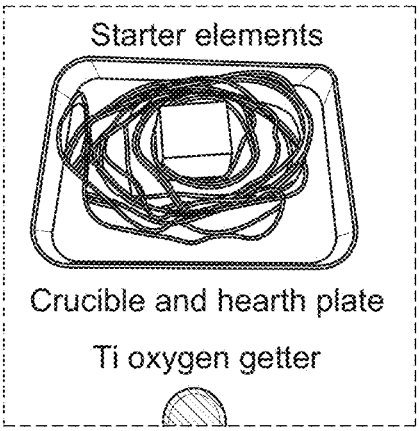
FIG. 1 is a photographic image of the inside of a representative VAR system, showing the copper hearth plate, tungsten-electrode, Ti oxygen getter, and components for making an alloy embodiment.

The following term definitions are provided to the reader, and should not be considered to provide a definition different from that known by a person of ordinary skill in the art. And, unless otherwise noted, technical terms are used according to conventional usage.

As used herein, the singular terms "a," "an," and "the" include plural referents unless context clearly indicates otherwise. Also, as used herein, the term "comprises" means "includes." Hence "comprising A or B" means including A, B, or A and B.

Unless explained otherwise, all technical and scientific terms used herein have the same meaning as commonly understood to one of ordinary skill in the art to which this disclosure belongs. Although methods and compounds similar or equivalent to those described herein can be used in the practice or testing of the present disclosure, suitable methods and compounds are described below. The compounds, methods, and examples are illustrative only and not intended to be limiting, unless otherwise indicated. Other features of the disclosure are apparent from the following detailed description and the claims.

Unless otherwise indicated, all numbers expressing quantities of components, molecular weights, percentages, temperatures, times, and so forth, as used in the specification or claims are to be understood as being modified by the term "about." Accordingly, unless otherwise indicated, implicitly or explicitly, the numerical parameters set forth are approximations that can depend on the desired properties sought and/or limits of detection under standard test conditions/methods. When directly and explicitly distinguishing embodiments from discussed prior art, the embodiment numbers are not approximates unless the word "about" is recited. Furthermore, not all alternatives recited herein are equivalents.

The following terms and definitions are provided:

Aging (or Artificial Aging, Precipitation Hardening, Heat Aging, Age Treatment or Age Hardening): A process that comprises heating an alloy to an elevated temperature, typically for several hours or days, where, during this treatment of an alloy, there may be a growth of secondary phases, including precipitates.

Alloy: It is established that an alloy is a combination comprising a metallic element with one or more other elements or compounds, wherein the other elements or compounds may be metallic or non-metallic.

Creep: A phenomenon wherein a material is deformed beyond its yield strength. Creep rupture is the end-point of the creep process wherein the material fails.

Grains: Crystallites that comprise solid metallic materials. Thus, grain boundaries are the perimeter or boundaries of grains found in metallic materials.

Hot Rolling: A process employed during initial alloy fabrication wherein an alloy is shaped or formed into articles of decreased cross-section areas about the recrystallization temperature.

Liquidus Temperature: The lowest temperature of an alloy at which an alloy is completely liquid.

Microstructure: The structure of the matrix phase and any secondary phases, including but not limited to the grain size, grain shape, the shape of secondary phases, the area/size/volume fraction of the secondary phases, and the chemical composition of the phases.

Partition Coefficient: For an alloy element, the partition coefficient is defined as the concentration of the element in the solid phase divided by the concentration of the element in the liquid phase at a given temperature.

Precipitates: One or more of the secondary phases in a solid metallic material. Precipitates in solid metallic materials are formed in a process known as precipitation wherein the solid metallic material cools (e.g., its temperature decreases) and the solubility of one or more elements in the solid metallic material decreases in the matrix phase and, as a consequence, precipitates form as there is phase separation between phases of different compositions.

Recrystallization: A process wherein the grains or crystallites of solid metallic materials are altered to form new crystal structures and/or crystal shapes. Recrystallization may or may not result in grain growth; that is, the growth in the size of grains in a solid metallic material.

Solid metallic materials: Materials comprised of a continuous matrix phase and possibly one or more secondary phases dispersed within the matrix phase. The size fraction, area fraction, or volume fraction of a secondary phase is defined by the fraction or percentage of 2-dimensional or 3-dimensional space of a solid metallic material which the secondary phase inhabits. As-wrought solid metallic material is the material following its initial fabrication, but prior to subsequent treatments of the material. The initial fabrication of an as-wrought solid metallic material may comprise a method of melting and re-melting the alloy, which is often utilized to limit the amount of low-Z elements present in the alloy. Producing solid metallic materials may involve oxidizing the material. In some embodiments, oxidation may involve producing oxides, which are chemical compounds that comprise at least one oxygen atom. Solid metallic materials also may be produced by carburization, which is a process that produces carbides (chemical compounds that comprise at least one carbon atom). Carburization and/or oxidation also may be utilized to produce scales or protective coatings, which have altered physical, mechanical, or chemical properties.

Solution Treatment (or Solution Heat Treatment or Solid-Solution Strengthening): A post-fabrication treatment that comprises heating an alloy above a temperature where all, or nearly all, alloy elements become soluble in the matrix phase, effectively eliminating all of the secondary phases while at that elevated temperature.

Solvus Temperature: For a secondary phase, the solvus temperature is the temperature at which that secondary phase becomes solvent in the matrix phase. The solidus temperature of an alloy is the highest temperature at which an alloy is completely solid.

Stain Hardening (or Work Hardening): A post-fabrication process for solid metallic materials wherein the solid metallic material has a stress applied, which results in deformation of the solid metallic material and dislocations in the lattice of the solid metallic material's lattice structure. As indicated by the names for this process, this process typically results in a hardening and increased strength of a solid metallic material.

Strain: A measure of material deformation.

Stress: An expression of a force load applied.

Superalloys: High-performance alloys that exhibit properties including, but not limited to, high mechanical strength, surface stability, and resistance to corrosion, oxidation, creep deformation, or high stresses or temperatures.

Supercritical fluids: Fluids existing under conditions where the fluid's pressure and temperature are both greater than the respective critical values, at which point the fluid cannot be categorized as either a gas or liquid. Often, supercritical fluids, e.g. supercritical $CO_2$, are often denoted by a lower case "s" before the supercritical chemical compound, e.g. $sCO_2$.

Thermodynamic/Kinetic Modeling: Using software to model predicted properties and characteristics of chemical species based, in part, upon the relative amounts of initial starting materials. The predicted properties and characteristics may include, but are not limited to, melting point, solidification profile, segregation profile, microstructures, response to heat treatments, phase formation, partition coefficients, liquidus and solidus lines, homogenization, and corrosion. Thermodynamic and kinetic modeling may utilize the Scheil-Gulliver equation, which makes a series of assumptions about diffusion of chemical species, chemical equilibrium or para-equilibrium, and behavior of liquidus and solidus temperatures, to predict, among other things, the nature of phases, such as the matrix phase and secondary phases, and their formation in the alloy.

Tensile Strength: A measure of the force required to elongate a material to the point of failure.

Yield Strength: The stress at which a material begins to deform.

II. Introduction

Commercial superalloys exist and some of the most common of these superalloys include Haynes 214, Haynes 230, and Inconel 740H. The nominal chemical compositions of these alloys are shown in Table 1, below.

TABLE 1

| Alloy | Ni | Cr | Co | Mo | W | Nb | Ti | Al | Fe | C |
|---|---|---|---|---|---|---|---|---|---|---|
| Haynes 214 | * | 16 | | | | | | 4.5 | 3.5 | 0.05 |
| Haynes 230 | * | 22 | 5 | 2 | 14 | | | 0.3 | 3 | 0.1 |
| Inconel 740H | * | 25 | 20 | 0.5 | | 2 | 1.8 | 0.9 | 0.7 | 0.03 |

| Alloy | B | N | Y | Ta | Hf | La | Zr | Mn | Si |
|---|---|---|---|---|---|---|---|---|---|
| Haynes 214 | 0.01 | | 0.01 | | | | 0.02 | 0.2 | 0.1 |
| Haynes 230 | 0.015 | | | | | 0.02 | | 0.5 | 0.4 |
| Inconel 740H | | | | | | | | 0.3 | 0.5 |

These alloys, and other superalloys known in the art, however, have limitations in their ability to exhibit high-temperature strength and corrosion resistance at high temperatures. Additionally, some such superalloys (e.g., Haynes 214) are not heat treatable.

Disclosed herein are alloy embodiments, and methods of making the same, exhibit superior mechanical (including thermomechanical) properties, corrosion resistance, and other properties that facilitate their use in various applications, particularly in supercritical fluid applications. The disclosed alloy embodiments comprise a combination of alloying components that, alone or in combination with the methods by which they are made, provide improved microstructures and/or oxide-based coatings that promote improved mechanical and corrosion resistance properties.

III. Alloy Embodiments

Disclosed herein are embodiments of a nickel-based alloy that comprises, as its main alloying components, nickel (Ni) and one or more base metals. Suitable base metals include, but are not limited to, aluminum (Al), chromium (Cr), cobalt (Co), copper (Cu), Iron (Fe), molybdenum (Mo), manganese (Mn), niobium (Nb), titanium (Ti), tungsten (W) vanadium (V), or any and all combinations thereof. In particular disclosed embodiments, the additional base metal is selected from Cu, Co, Fe, Al, or Mn. Particular alloy embodiments can comprise, consist essentially of, or consists of, Ni and one or more additional base metal selected from Cu, Co, Fe, Al, Mn, W, Cr, Mo, Nb, Ti, or any combination thereof. In this context, "consists essentially of" means that the nickel-based alloy does not include additional components that affect the chemical and/or mechanical properties of the alloy by more than 10%, such as 5% to 2%, relative to a comparable nickel-based alloy that is devoid of the additional components. Alloy embodiments described also can contain innocuous amounts of various impurities that have no substantial effect on the chemical and/or mechanical properties of the alloys. Also, in some embodiments, the alloy can further comprise boron (B), silicon (Si), phosphorus (P), sulfur (S), or any and all combinations thereof. In some embodiments, greater than 0 wt % to 1% B, P, Si, S, or any combination thereof can be included.

Alloy embodiments of the present disclosure can comprise Ni in amounts ranging from greater than 0 wt % to 80 wt %, such as 34 wt % to 75 wt %, or 40 wt % to 65 wt %. In some embodiments, the alloy also can comprise one or more additional base alloy components selected from Cr, Co, Nb, Al, and combinations thereof. Cr can be included in an amount ranging from greater than 0 wt % to 30 wt %, such as 15 wt % to 30 wt %, or 20 wt % to 30 wt %. Co can be included in an amount ranging from greater than 0 wt % to 20 wt %, such as 5 wt % to 18 wt %, or 10 wt % to 15 wt %. Niobium can be included in an amount ranging from 0 wt % to 10 wt %, such as 0.5 wt % to 4 wt %, or 1 wt % to 3 wt %. Aluminum can be included in an amount ranging from greater than 0 wt % to 10 wt %, such as 0.05 wt % to 5 wt %, or 1 wt % to 5 wt %. In some embodiments, the alloy can further comprise one or more of C, Mo, W, Ti, Fe, B, Mn, Si, Cu, P, S, or combinations thereof. In some such embodiments, the alloy can comprise C in an amount ranging from greater than 0 wt % to 1 wt %, such as 0.02 wt % to 0.5 wt %, or 0.05 wt % to 0.1 wt %. In some embodiments, the alloy can comprise Mo in an amount ranging from 0 wt % to 20 wt %, such as greater than 0 wt % to 15 wt %, or 5 wt % to 10 wt %. The W, if present, can be included in an amount ranging from 0 wt % to 20 wt %, such as greater than 0 wt % to 15 wt %, or 5 wt % to 10 wt %. The Ti, if present, can be included in an amount ranging from greater than 0 wt % to 5 wt %, such as 0.5 wt % to 4 wt %, or 1 wt % to 3 wt %. Fe, if present, can be included in an amount ranging from greater that 0 wt % to 15 wt %, such as 0.5 wt % to 4 wt %, or 1 wt % to 3 wt %. If B is present, it can be included in an amount ranging from greater than 0 wt % to 1 wt %, such as 0.001 wt % to 0.02 wt %, or 0.001 wt % to 0.01 wt %. If Mn is present, it can be included in an amount ranging from greater than 0 wt % to 5 wt %, such as greater than 0 wt % to 2 wt %, or greater than 0 wt % to 0.1 wt %. In embodiments comprising Si, the Si can be present in an amount ranging from greater than 0 wt % to 5 wt %, such as greater than 0 wt % to 2 wt %, or greater than 0 wt % to 0.1 wt %. In embodiments comprising Cu, the Cu can be present in an amount ranging from greater than 0 wt % to 1 wt %, such as greater than 0 wt % to 0.1 wt %, or 0.01 wt % to 0.1 wt %. In embodiments comprising P, the P can be present in an amount ranging from greater than 0 wt % to 1 wt %, such as greater than 0 wt % to 0.1 wt %, or greater than 0 wt % to 0.001 wt %. Similar, if the alloy comprises S, the S can be present in an amount ranging from greater than 0 wt % to 1 wt %, such as greater than 0 wt % to 0.1 wt %, or greater than 0 wt % to 0.001 wt %. In yet some additional embodiments, the alloy can comprise one or more transition metals and/or rare earth elements (e.g., lanthanides, yttrium, etc.) or combinations thereof. In some embodiments, the alloy can further comprise Y, Ta, Hf, La, Zr, or any combination thereof. In some embodiments, the alloy can further comprise Y in an amount ranging from greater than 0 wt % to 0.5 wt %, such as 0.001 wt % to 0.1 wt %, or 0.001 wt % to 0.01 wt %. If some embodiments, the alloy can comprise Ta in an amount ranging from greater than 0 wt % to 0.01 wt %, such as 0.0001 wt % to 0.01 wt %, or 0.0001 wt % to 0.001 wt %. In yet additional embodiments, the alloy can comprise one or more of Hf, La, or Zr, wherein each independently is present in an amount ranging from greater than 0 wt % to 0.05 wt %, such as 0.01 wt % to 0.04 wt %, or 0.01 wt % to 0.02 wt %.

Representative alloy embodiments are described in Table 2, below. Alloys 1C, 2C, 3C, and 4C can further comprise 0.01 wt % Hf, 0.02 wt % La, and 0.02 wt % Zr. In some embodiments, alloy 1D can further comprise less than 0.01 wt % Ta.

TABLE 2

| Alloy | Ni | Cr | Co | Mo | W | Nb | Ti | Al | Fe | C | B | Y (as $Y_2O_3$) |
|---|---|---|---|---|---|---|---|---|---|---|---|---|
| Alloy 1A | 55.45 | 20 | 15 | | | 2 | 2 | 4.5 | 1 | 0.05 | | |
| Alloy 1B | 50.45 | 20 | 15 | | | 4.5 | 4.5 | 4.5 | 1 | 0.05 | | |
| Alloy 1C | 55.45 | 20 | 15 | | | 2 | 2 | 4.5 | 1 | 0.05 | 0.01 | 0.01 |
| Alloy 1D | 60.46 | 20 | 5 | 1 | | 4 | 0.5 | 4 | 5 | 0.04 | | |
| Alloy 1E | 54.85 | 20.87 | 15.45 | <0.010 | <0.010 | 2.00 | 1.96 | 3.84 | 0.99 | 0.05 | | |
| Alloy 2A | 47.4 | 20 | 5 | 5 | 15 | | | 4.5 | 3 | 0.1 | | |
| Alloy 2B | 47.4 | 20 | 5 | 15 | 5 | | | 4.5 | 3 | 0.1 | | |
| Alloy 2C | 47.4 | 20 | 5 | 5 | 15 | | | 4.5 | 3 | 0.1 | 0.01 | 0.01 |
| Alloy 3A | 44.9 | 25 | 5 | 5 | 15 | 2 | 2 | 1 | | 0.1 | | |
| Alloy 3B | 34.9 | 25 | 15 | 15 | 5 | 2 | 2 | 1 | | 0.1 | | |
| Alloy 3C | 44.9 | 25 | 5 | 5 | 15 | 2 | 2 | 1 | | 0.1 | 0.01 | 0.01 |
| Alloy 3D | 49.75 | 20 | 10 | 10 | 5 | 2 | 1.5 | 0.7 | 1 | 0.05 | | |
| Alloy 4A | 43.9 | 25 | 10 | 5 | 10 | 2 | 2 | 1 | 1 | 0.1 | | |
| Alloy 4B | 50.4 | 15 | 10 | 5 | 10 | 2 | 2 | 4.5 | 1 | 0.1 | | |
| Alloy 4C | 43.9 | 25 | 10 | 5 | 10 | 2 | 2 | 1 | 1 | 0.1 | 0.01 | 0.01 |

Alloy embodiments disclosed herein can comprise a microstructure. The microstructure can comprise different phases of particular intermetallics. Representative microstructures and/or intermetallic phases of particular alloy embodiments are described in the Examples section. In some embodiments, the microstructure and/or intermetallics can be evaluated and identified using optical microscopy and/or diffraction techniques. These techniques can be used to determine the grain and dendritic structure of the material's microstructure. Examples of such techniques include, but are not limited to, scanning electron microscopy (SEM), scanning electron microscopy-back scattered electron imaging (SEM-BSE), secondary-electron imaging (SE), transmission electron microscopy (TEM), selected area diffraction (SAED), high resolution X-ray diffraction (XRD), energy-dispersive X-ray spectroscopy (EDX), electron energy loss spectroscopy (EELS), or combinations thereof. In some embodiments, SAED, EDX, EELS, or high resolution XRD can be used to evaluate any carbide-based phases in the alloy embodiments.

In some embodiments, SAED may provide information concerning properties of a fraction of a TEM image, and thus can be used to evaluate the presence of phases within the alloy's microstructure, including those phases that comprise a small size fraction, lattice structure, and lattice defects of the material's microstructure, as well as the microstructure's secondary phases. In some embodiments, EDS, BSE, and/or EELS analysis can be paired with either SEM or TEM microscopy to analyze an alloy's microstructure. This analysis can be used to evaluate chemical composition or relative abundance of elements present in the alloy, including for a fraction of an image; thus, such methods can be used to determine the stoichiometry of the analyzed sample, including of the varying phases of the alloy. In some embodiments, SE analysis can be paired with SEM to evaluate morphological information relating to the alloy and its microstructure.

IV. Methods

A. Methods of Making Alloy Embodiments

The present disclosure includes methods of preparing alloys and the solid metallic materials therefrom. In some embodiments, this disclosure comprises methods of preparing alloys that are suitable for use as vessels, boilers, piping, and other receptacles that contain or come into contact with supercritical fluids.

In some embodiments, the method can comprise combining nickel metal with one or more additional base metals as described herein. In some embodiments, the nickel metal can be pre-melted before being combined with the one or more additional base metals. In other embodiments, the nickel metal and the one or more additional base metals can be combined and then melted. In yet additional embodiments, the nickel metal and the one or more additional base metals can be provided as a master alloy in which these constituents are pre-mixed. The master alloy can then be melted. In any or all of these embodiments, additional alloying constituents can be added during the mixing and/or melting steps. Exemplary methods for forming the melted alloy composition can include, but are not limited to, vacuum induction melting (VIM), vacuum arc re-melting (VAR), electroslag re-melting (ESR), plasma arc melting (PAM), cold-hearth melting (CHM), selective laser melting (SLM), electron beam melting (EBM), spark plasma sintering (SPS), selective laser sintering (SLS), conventional sintering (CS), or any combination thereof. After the alloy components are mixed and melted, they can be cast in a mold. In some embodiments, the mold is pre-heated at a particular temperature.

Additional method steps that can be used in some embodiments include, but are not limited to, heat treatments, such as solution annealing, aging, forming protective coatings, and/or pre-conditioning; and/or one or more modification processes, such as self-propagating high temperature synthesis (SHS), or hot isostatic pressing (HIP). In yet some additional embodiments, the alloy can be prepared using a metal injection molding (MIM) process, or a laser engineered net shaping (LENS) process. In some embodiments, a homogenization step can be used, wherein the temperature and duration of said homogenization can be determined by thermodynamic and kinetic analysis. In some embodiments, solid metallic materials may undergo homogenization. In some embodiments, solid metallic materials may undergo a solution treatment, an aging treatment, and/or a strain hardening treatment.

In some embodiments, solid metallic materials may be initially fabricated into ingots with masses of 5 kg or less. In some embodiments, solid metallic materials may be initially fabricated into ingots with masses of 1 kg or less. In some embodiments, solid metallic materials may be initially fabricated into ingots with masses of 100 g or less. In some embodiments, solid metallic materials may be initially fabricated into ingots using a VAR process. In some embodiments, the method can further comprise one or more re-melting steps, such as one re-melting step, or two re-melting steps, or three re-melting steps, and the like. In some embodiments, solid metallic materials may be initially fabricated into ingots with masses of 5 kg or more. In some embodiments, solid metallic materials may be initially fabricated into ingots with masses of 100 kg or more. In some embodiments, solid metallic materials may be initially fabricated into ingots with masses of 500 kg or more. In some embodiments, solid metallic materials may be initially fabricated into ingots with masses of 1,500 kg or more.

Figure 2:
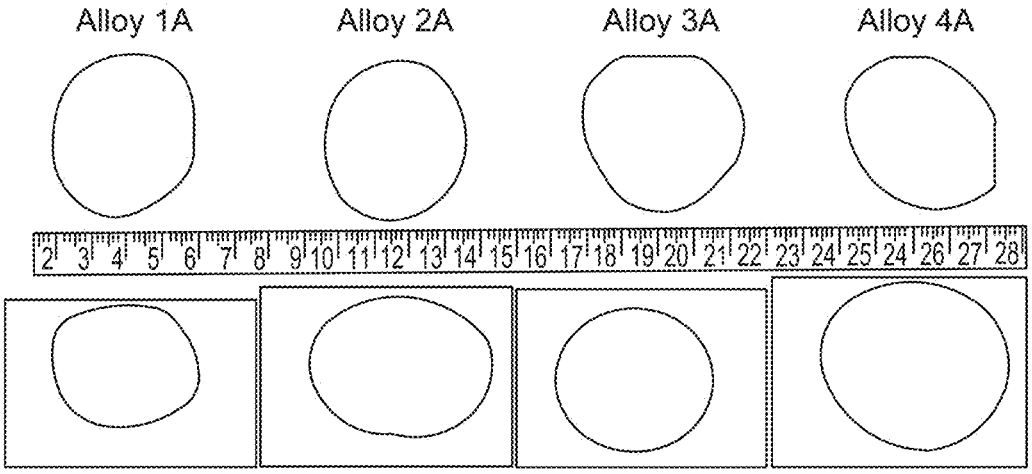
FIG. 2 is a photographic image of as-melted VAR buttons of certain representative alloy embodiments (Alloys 1A, 2A, 3A, and 4A) after initial melt in flowing Ar (top row), and after secondary re-melting (bottom row).

FIG. 1 displays a representative crucible used to form a melted alloy. The alloy components can be added to the crucible, which can be equipped with a titanium oxygen getter, to help minimize oxidation. In some embodiments, a VAR system comprising a stinger and a vacuum pump unit can be used in the method. In some representative embodiments, the VAR system was used at vacuum pressures less than $5\times10^{-2}$ Torr (or $6\times10^{-5}$ bar). In some embodiments, the VAR system can be backfilled with an inert gas, such as Ar or $N_2$. Images of representative ingot samples are shown in FIG. 2.

Figure 3A:
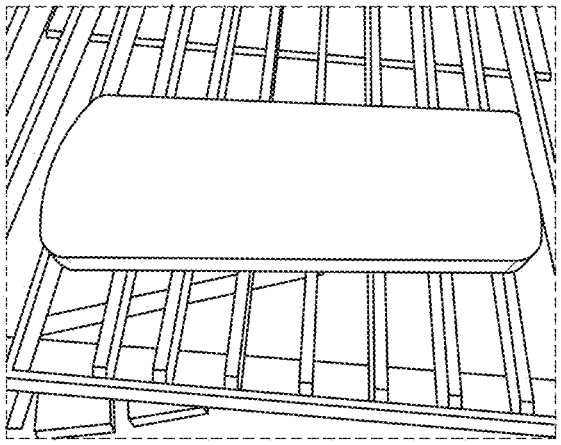
FIGS. 3A and 3B are photographic images of an as-hot-rolled plate of representative Alloy 1A (FIG. 3A) and various sample geometries cut using electrical discharge manufacturing (EDM) from the hot-rolled plate (FIG. 3B).
Figure 3B:
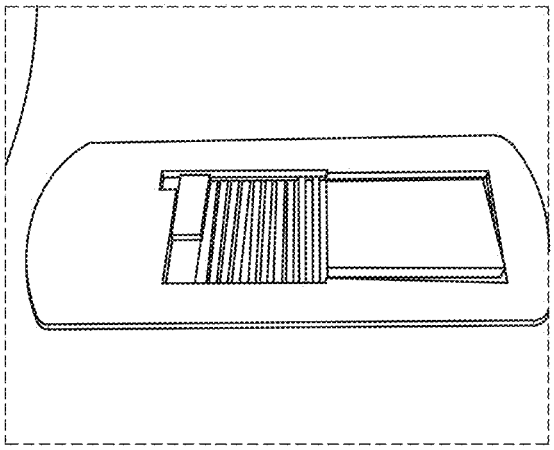

In some embodiments, solid metallic materials may be initially fabricated into ingots of 5 kg or more using a VIM process. In some embodiments, such methods can further comprise hot-rolling the resulting ingots. In some embodiments, hot-rolling comprises at least one pass of the ingot through a press at an elevated temperature, thereby reducing the cross-sectional area of the ingot. The cross-sectional area of the ingot can be reduced by 10% or more using hot-rolling, such as by 25% or more, or 50% or more, or 75% or more, or 90% or more. In exemplary embodiments, a hot rolling stand can be used when hot-rolling the alloy. FIGS. 3A and 3B display an image of an exemplary as-hot-rolled plate formed from hot-rolling a representative alloy (Alloy 1A) and various sample geometries cut using electrical discharge machining (EDM) from the hot-rolled plate, respectively.

B. Methods for Designing Alloy Compositions

Figure 4:
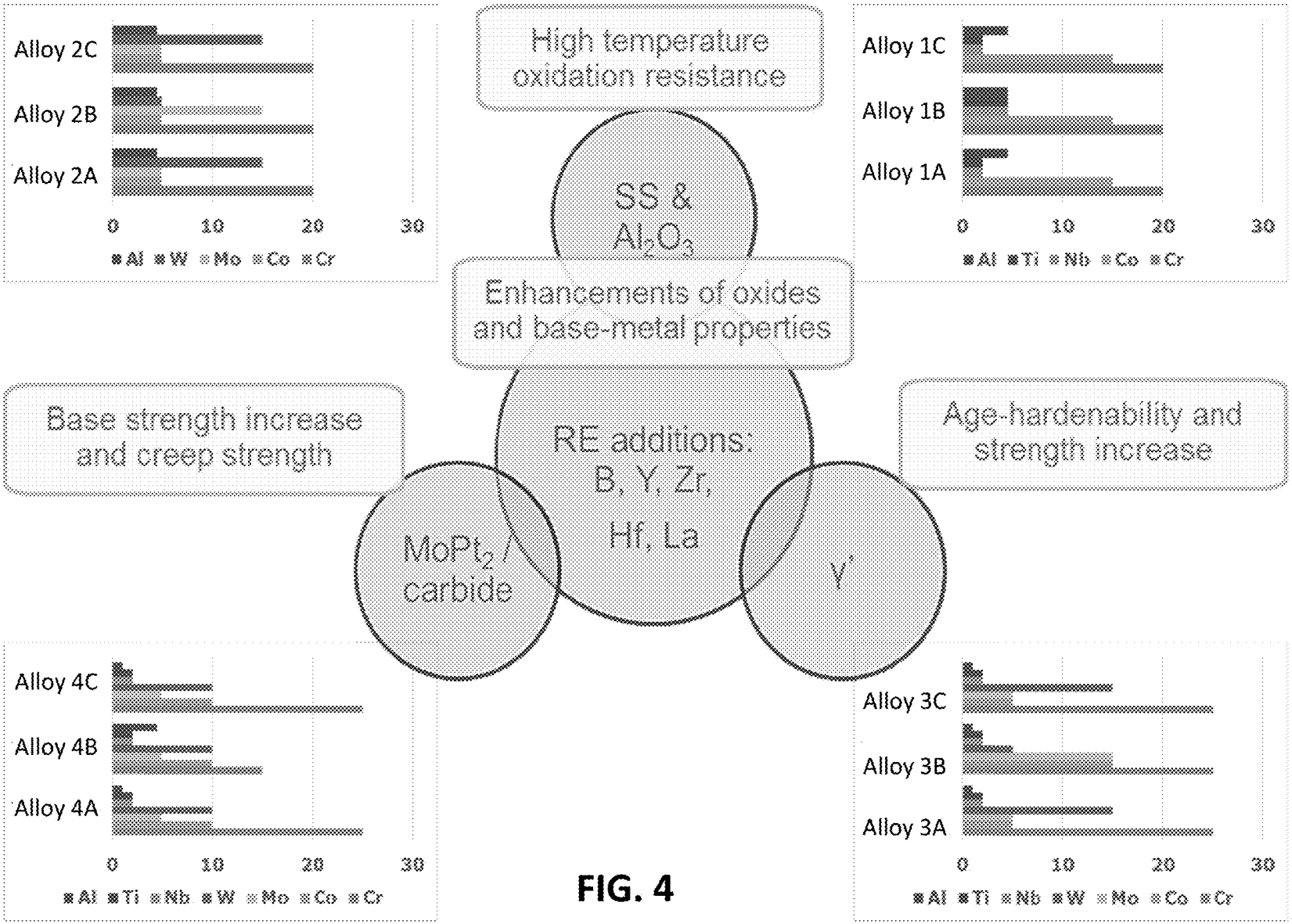
FIG. 4 is a schematic image showing various representative alloy components and including a Venn diagram of alloy design principles used to prepare certain alloy embodiments.

Also disclosed herein are methods for designing alloy compositions. Such methods can be used to select particular constituent alloy species for an alloy composition and/or to select fabrication methods that can be used to improve certain properties of an alloy composition. In some embodiments, methods of making alloy embodiments are described wherein the constituent alloy species that make-up the alloys are selected by considering the constituent alloy species' individual and cumulative material properties. FIG. 4 provides a schematic illustrating a representative method whereby constituent alloy species are selected and their amounts modified according to a particular desired property and/or feature. As illustrated in FIG. 4, different constituent alloy species are divided into species which have high temperature oxidation resistance, species which result in precipitation or gamma-prime (γ') secondary phases, species with high base and creep strength, and other species with provide material property enhancements. FIG. 4 also includes representative relative mass percentages of the constituent alloy species certain alloy embodiments disclosed herein, such as alloy embodiments 1A-1C, 2A-2C, 3A-3C, and 4A-4C.

In some embodiments, the method for making the alloy embodiments described herein can comprise an initial modeling step to determine binding energies that particular species present in supercritical fluids (e.g., $sCO_2$) environments will exhibit towards regions and/or surfaces of the alloy embodiment. Species typically present in supercritical fluids can include, but are not limited to, $CO_2$, CO, C, and O. This exemplary method step provides an understanding of the energetic and atomistic relationships between alloying elements in the metal-matrix and the reactive environment species, such as those listed above.

Figure 5:
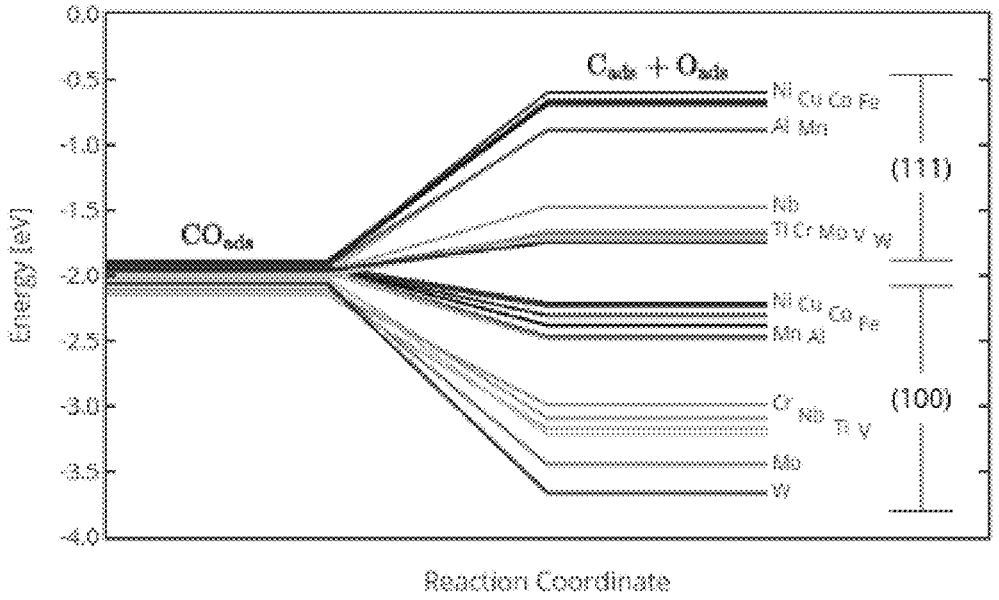
FIG. 5 is a graph of energy (eV) as a function of reaction coordinate showing binding energies of CO and its dissociation products, C and O, onto different binary Ni-alloy surfaces wherein all energies are relative to a CO molecule in vacuum.

FIG. 5 displays first-principles modeling of the binding energy of dissociated adsorbed CO ($CO_{(ads)}\rightarrow C_{(ads)}+O_{(ads)}$) on various nickel-based alloys comprising different base alloys, such as W, Mo, V, Cr, Nb, Ti, Cu, Co, Fe, Al or Mn and the different surface textures of these alloys (represented by "100" and "111" in FIG. 5). Using FIG. 5, it is possible to discern that the dissociation of CO into C and O, and their adsorption on the surface, becomes more thermodynamically favorable for all of the alloying element additions onto (100) surface textures. Also, as can be seen in FIG. 5, the dissociation of CO into C and O, and their adsorption on the surface, does not, in some embodiments, become more thermodynamically favorable for all of the alloying element additions onto (111) surface textures. The examples illustrated in FIG. 5 suggest that, in some independent embodiments, surfaces of pure Ni and Ni alloyed with another base metal, such as Cu, Co, Fe, Al or Mn, may bind oxygen more strongly than nickel-based alloys comprising W, Mo, V, Cr, Nb, or Ti. Using such modeling information, it is possible to evaluate the particular components to include in a nickel-based alloy based on how they will bind with species present in a particular environment (e.g., an environment wherein supercritical fluids may be present). While this step can be used to evaluate potential constituent alloy species, it is not intended to limit the particular constituent alloying species present in alloy embodiments of the present disclosure.

Figure 6:
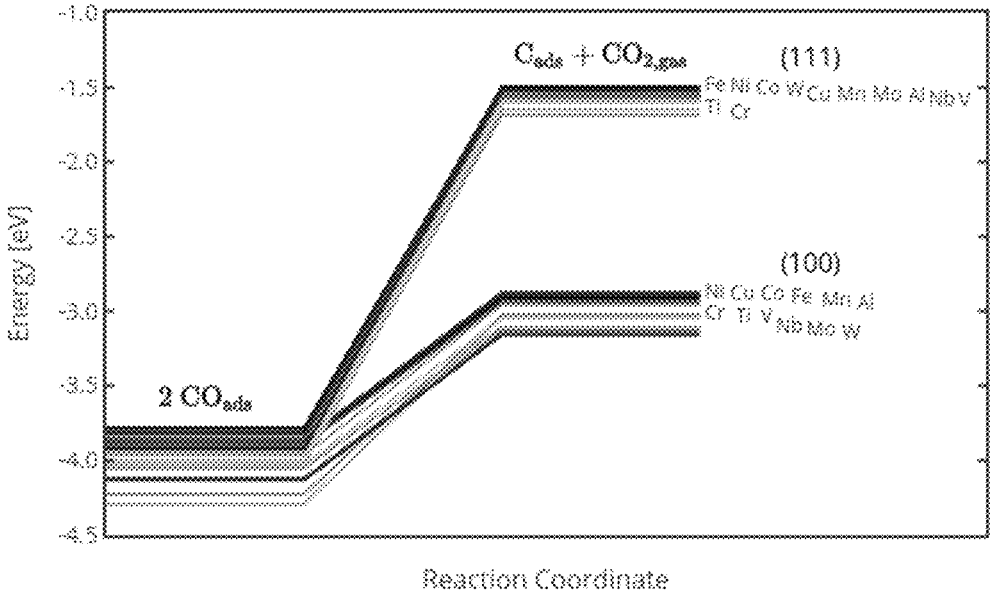
FIG. 6 is a graph of energy (eV) as a function of reaction coordinate showing binding energies of the species involved in the Boudouard reaction onto different binary Ni-alloy surfaces; all energies are relative to two CO molecules in vacuum.
Figure 7A:
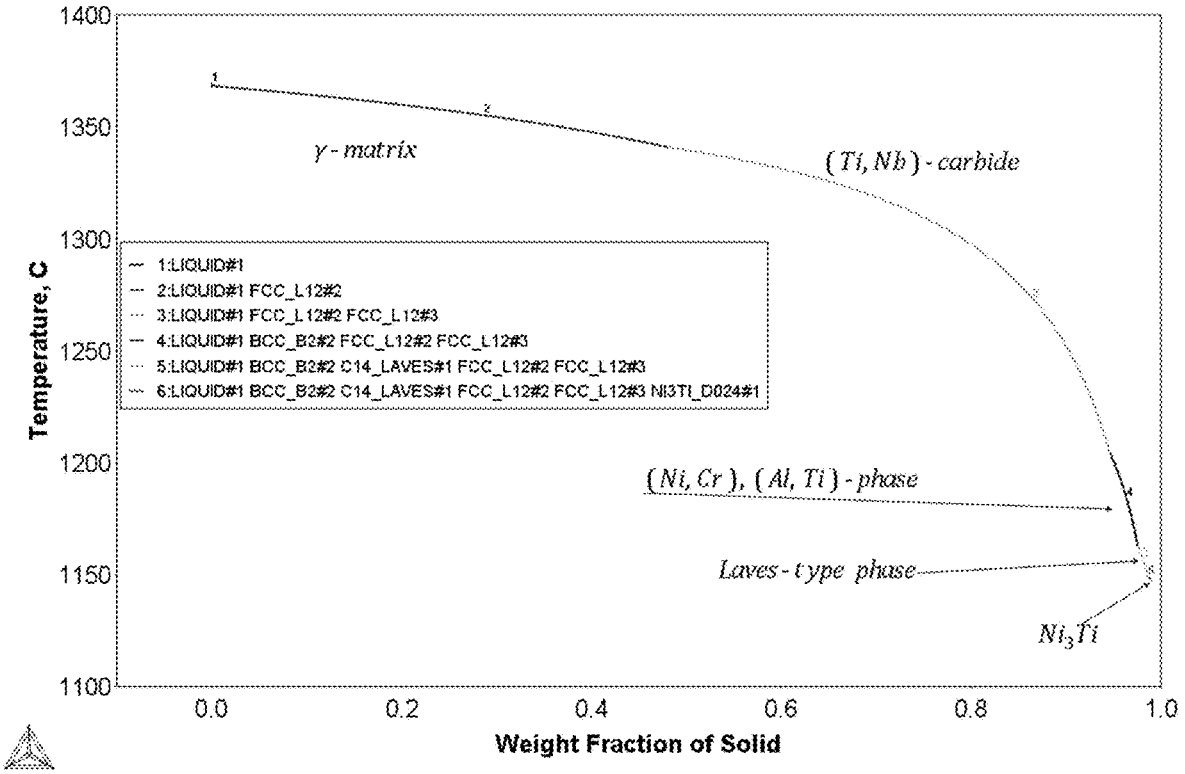
FIGS. 7A-7D are graphs of temperature (° C.) as a function of weight fraction of solid showing Scheil-Guliver solidification plots from ThermoCalc® for certain representative alloy embodiments, Alloy 1A (FIG. 7A), Alloy 2A (FIG. 7B), Alloy 3A (FIG. 7C), and Alloy 4A (FIG. 7D).
Figure 7B:
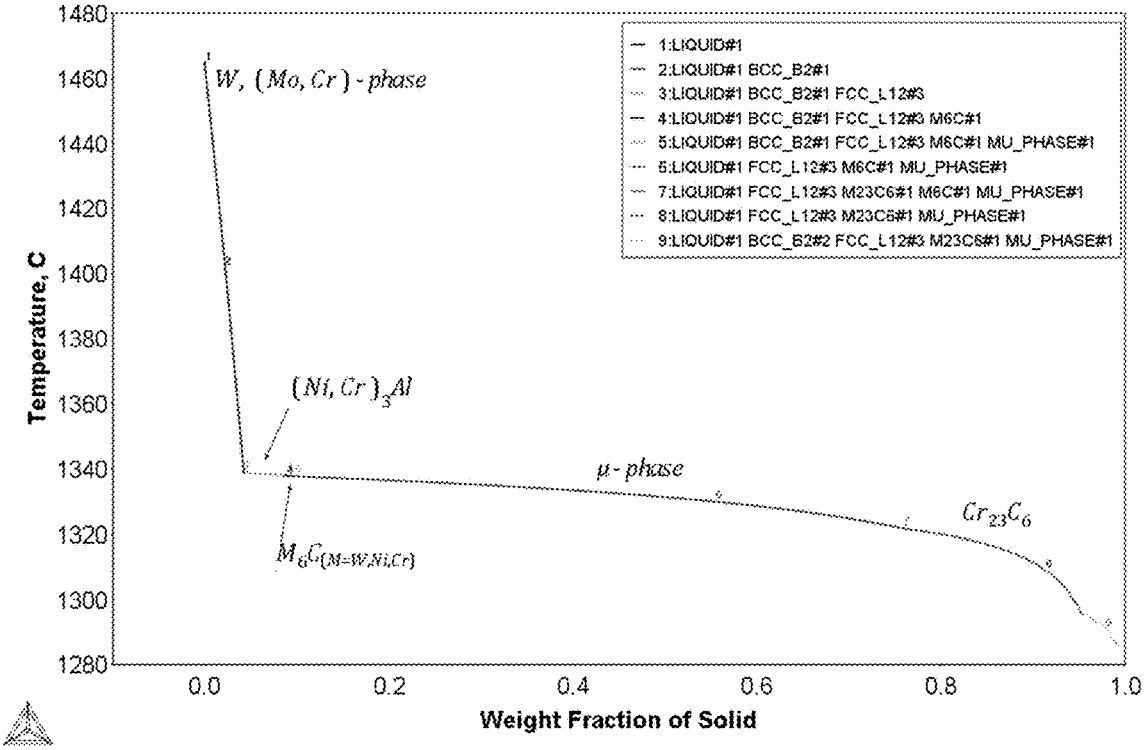
Figure 7C:
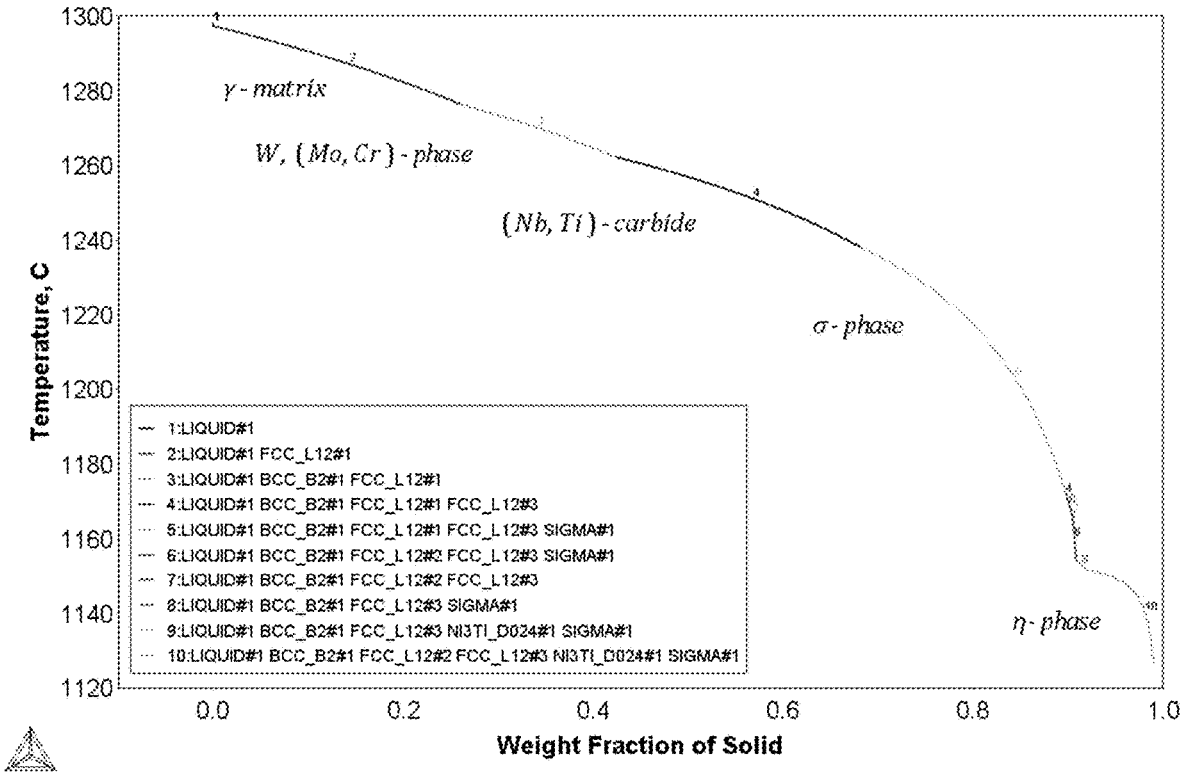
Figure 7D:
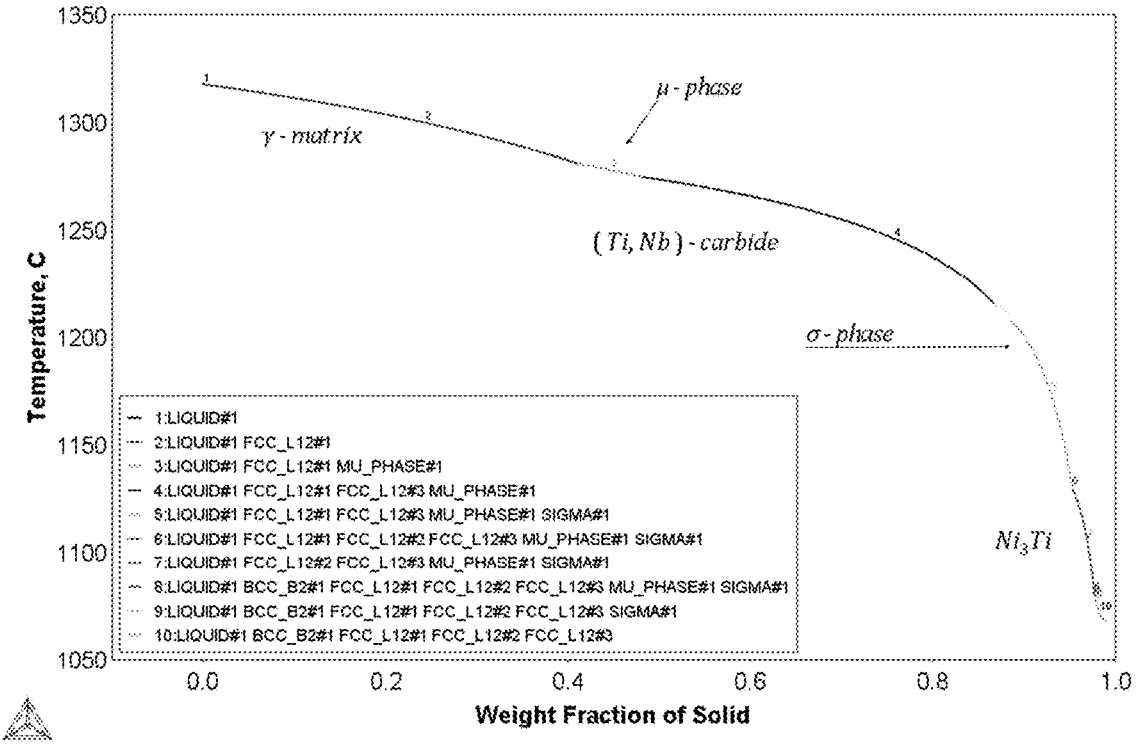

Similarly, FIG. 6 displays first-principles modeling of the binding energy of the products of the Boudouard reaction (i.e., $2CO_{(ads)} \approx CO_{2(g)} + C_{(ads)}$) on different binary model alloys of Ni and different surface textures of these alloys, namely (100) and (111). In some embodiments, as can be seen in FIG. 6, the products of the Boudouard reaction may not be more thermodynamically favorable for all of the alloying element additions onto either the (100) or (111) surface textures. In a particular embodiment, the modeling calculations used to generate the data of FIG. 6 suggest that surfaces of pure Ni and Ni alloyed with either Cu, Co, Fe, Al or Mn may bind the products of the Boudouard reaction more strongly than alloys with W, Mo, V, Cr, Nb, or Ti. While this step can be used to evaluate potential constituent alloy species, it is not intended to limit the particular constituent alloying species present in alloy embodiments of the present disclosure.

Also disclosed herein are method embodiments for designing alloys and solid metallic materials that satisfy varying physical, mechanical, and performance properties. Such methods can include conducting thermodynamic and kinetic analyses with potential constituent alloy species. Because, in some embodiments, the starting alloy elements and alloy fabrication methods can influence the eventual physical, mechanical, and performance properties of the resultant alloy, thermodynamic and kinetic analysis may be used to confirm the influence of potential fabrication steps on the alloy's microstructure, including providing the ability to determine phases occurring for an alloy composition. Such methods can be used to determine whether a solid metallic material will have certain desirable properties by evaluating the material's eventual microstructure. In some embodiments, thermodynamic and kinetic analysis is conducted by evaluating equilibrium and para-equilibrium states of an alloy during fabrication or subsequent treatments. In some embodiments, computer-aided software is used for such evaluations. In some embodiments, one or more of the following can be used or considered in such evaluations: phase diagrams; thermodynamic properties of phases or substances; chemical properties, such as phase fraction, enthalpy or specific heat capacity; liquidus and/or solidus temperatures; phase boundaries; oxide and carbide layer formation; corrosion properties; solidification profiles; kinetics of processes; partition coefficients; or combinations thereof. In some embodiments, the solidification properties can be evaluated using the Scheil-Gulliver equation. In representative embodiments, ThermoCalc® proprietary software may be utilized to conduct thermodynamic and kinetic analysis. In other representative embodiments, JmatPro 6.0® proprietary software may be utilized to conduct thermodynamic and kinetic analysis.

In some embodiments, diffusion, including back-diffusion, of varying constituent alloy species during the initial fabrication and post-fabrication treatments is considered when designing alloy embodiments. Determining the diffusion of species, often with the aid of computer-aided software, can be beneficial in determining which fabrication and/or treatment methods to use when preparing an alloy. In some embodiments, the material's microstructure is evaluated when attempting to determine the dynamics of diffusion during the initial fabrication or post-fabrication treatments of the varying species present in an alloy. In some embodiments, any one or more of the following can be assessed when evaluating diffusion characteristics: homogenization and kinetics thereof, the formation or dissolution of secondary phases, segregation, formation of scales or protective coatings, and carburization and/or oxidation processes. In some representative embodiments, DICTRA® proprietary software is used to evaluate diffusion characteristics of different constituent alloy species during initial fabrication and subsequent treatments.

In some embodiments, conditions and/or other parameters for certain treatment steps used in the method of making alloy embodiments can be evaluated. For example, in embodiments using a homogenization treatment, the temperature and duration of the homogenization can be determined using thermodynamic and kinetic analysis (e.g., such as by utilizing the proprietary software DICTRA®). In embodiments using a solution treatment, the temperature and duration of the solution treatment can be determined by thermodynamic and kinetic analysis, such as analysis of the equilibrium plot of the material. In some embodiments, solid metallic materials may undergo solution treatment, wherein an equilibrium plot of the material indicates temperatures for solution treatment above which at least the one secondary phase loses its phase stability.

In some embodiments, thermodynamic and kinetic analysis may be used to evaluate an alloy's solidification profile. In some embodiments, thermodynamic and kinetic analysis utilizing Scheil-Guliver calculations may be used to determine an alloy's solidification profile. In some representative embodiments, the proprietary software ThermoCalc® may be used to evaluate an alloy's solidification profile. FIGS. 7A-7D illustrate the Scheil-Guliver solidification plots, as derived by ThermoCalc®, for certain representative alloys (namely, Alloy 1A (FIG. 7A), Alloy 2A (FIG. 7B), Alloy 3A (FIG. 7C), and Alloy 4A (FIG. 7A)). For the solidification reactions that produced the data in FIGS. 7A-7D, infinite diffusion was assumed for all elements in the liquid phase and none in all solid phases. The optional back-diffusion in solid phases, for interstitial elements such as C, O, N, was not used. The evaluations used a $\Delta T$ of 5° C. and the final fraction of liquid phase was set at 0.01.

Figure 8A:
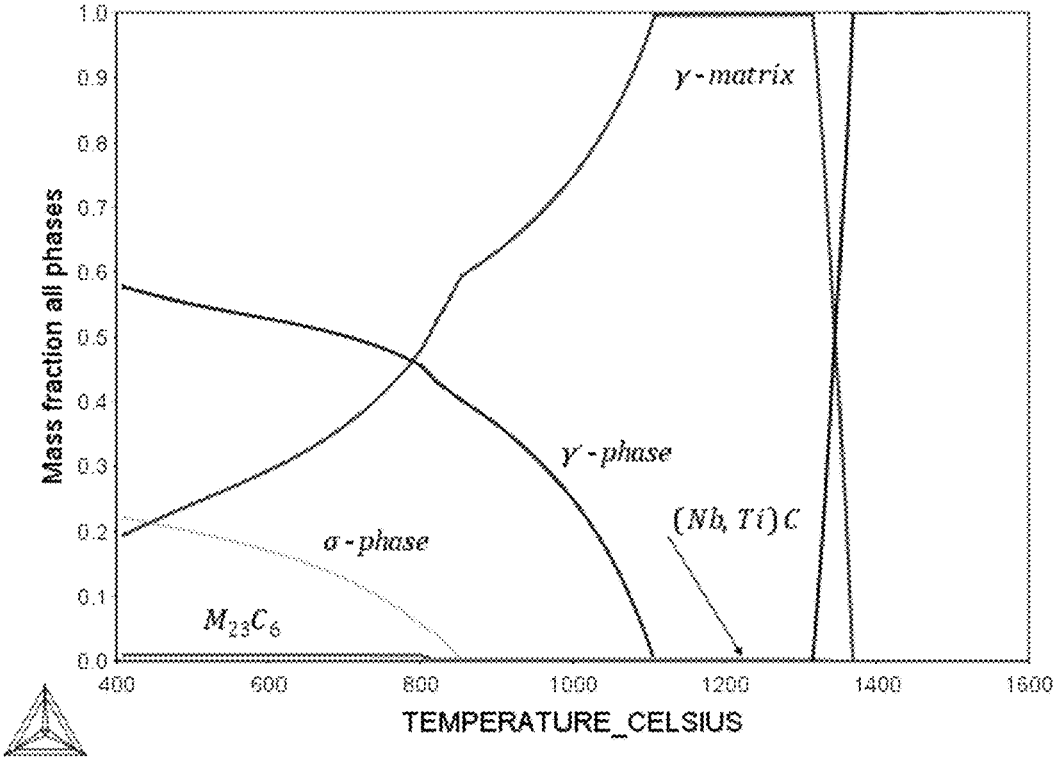
FIGS. 8A-8D are graphs of mass fraction of all phases as a function of temperature (° C.) showing equilibrium plots from ThermoCalc® for certain representative alloy embodiments, Alloy 1A (FIG. 8A), Alloy 2A (FIG. 8B), Alloy 3A (FIG. 8C), and Alloy 4A (FIG. 8D).
Figure 8B:
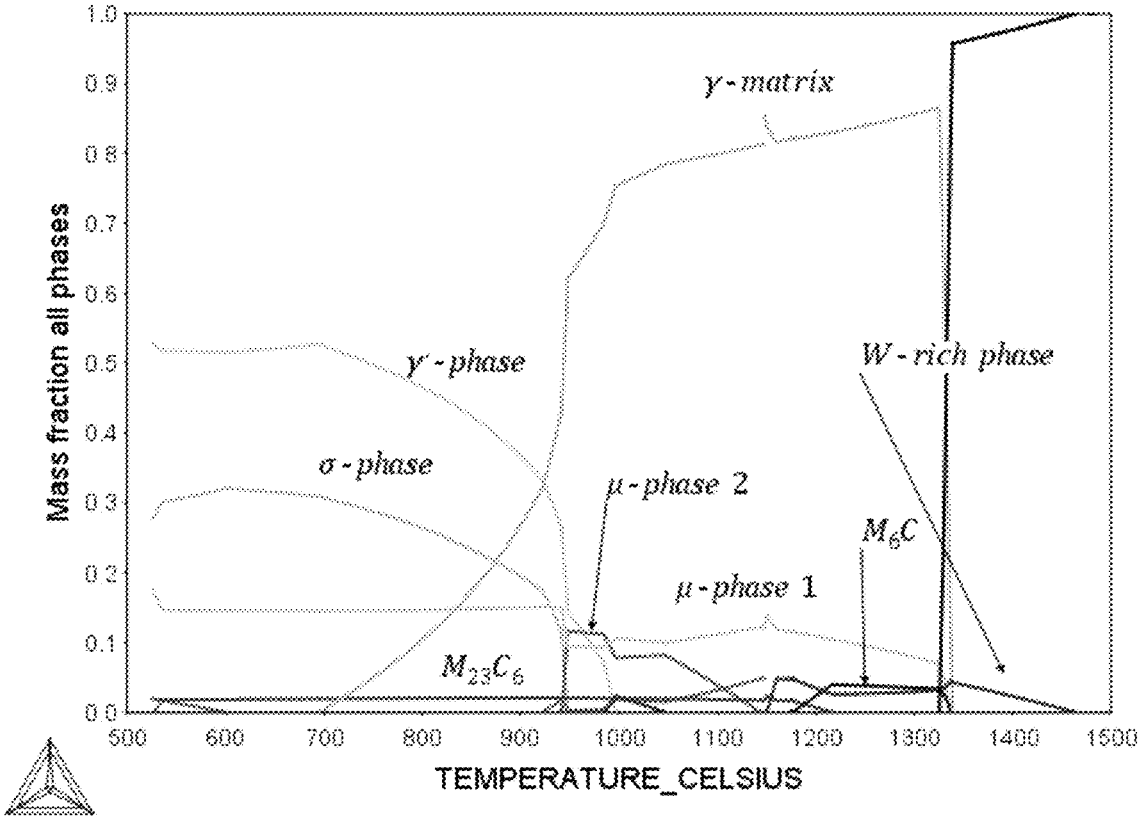
Figure 8C:
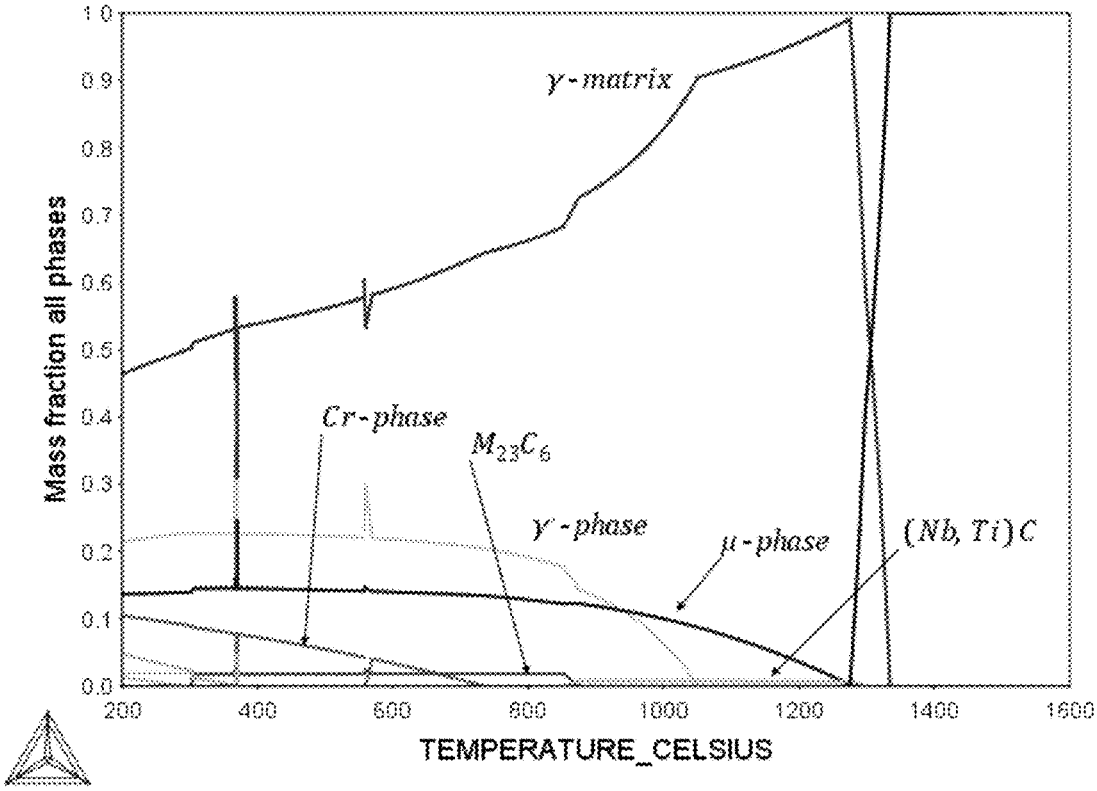
Figure 8D:
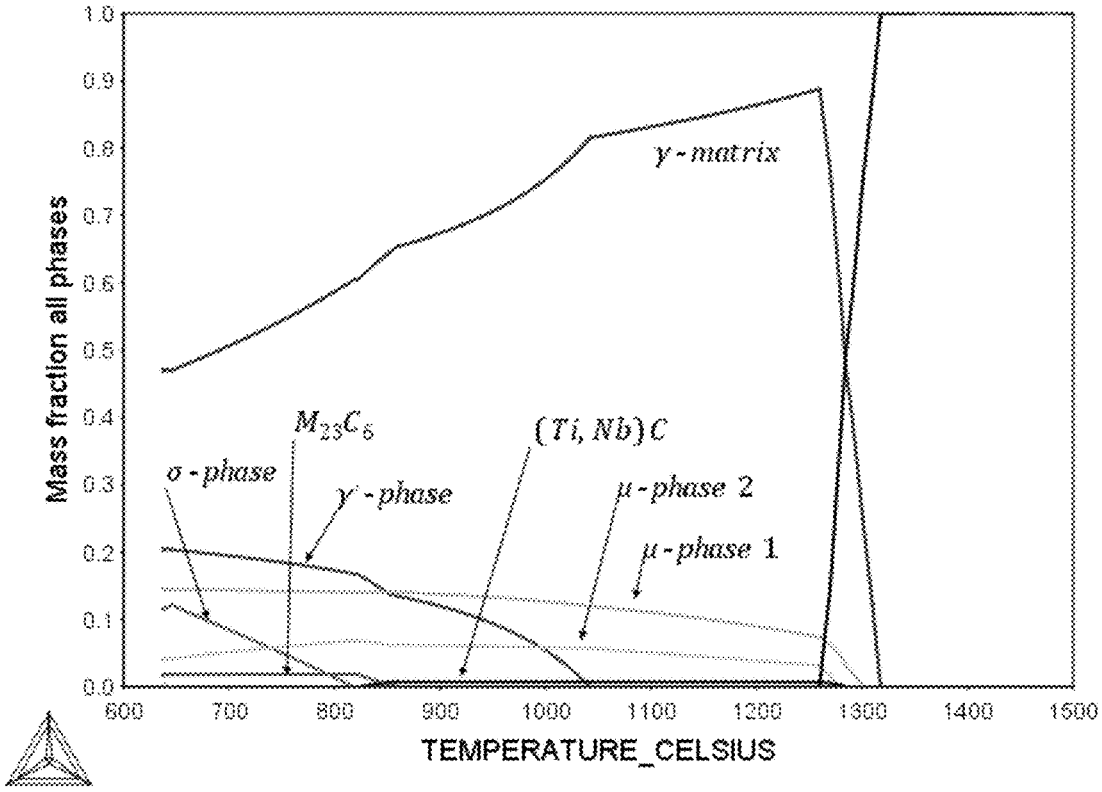

In some embodiments, thermodynamic and kinetic analysis may be used to determine an alloy's equilibrium plot. In some representative embodiments, thermodynamic and kinetic analysis utilizing ThermoCalc® is used to determine an alloy's equilibrium plot. FIGS. 8A-8D illustrate the equilibrium plots utilizing a stepping calculation for the same four alloys of FIGS. 7A-7D. Given information from FIGS. 7A-7D and FIGS. 8A-8D, all secondary phases, except the MC-type carbide phase, should be in solution for alloy embodiment 1A after successful homogenization and solution heat-treatment. FIG. 8A suggests that the phase stability for the γ'-phase in Alloy 1A ends at around 1100° C.; thus, the solution treatment temperature may be set at a temperature above that point to dissolve the other secondary phases.

Figure 9:
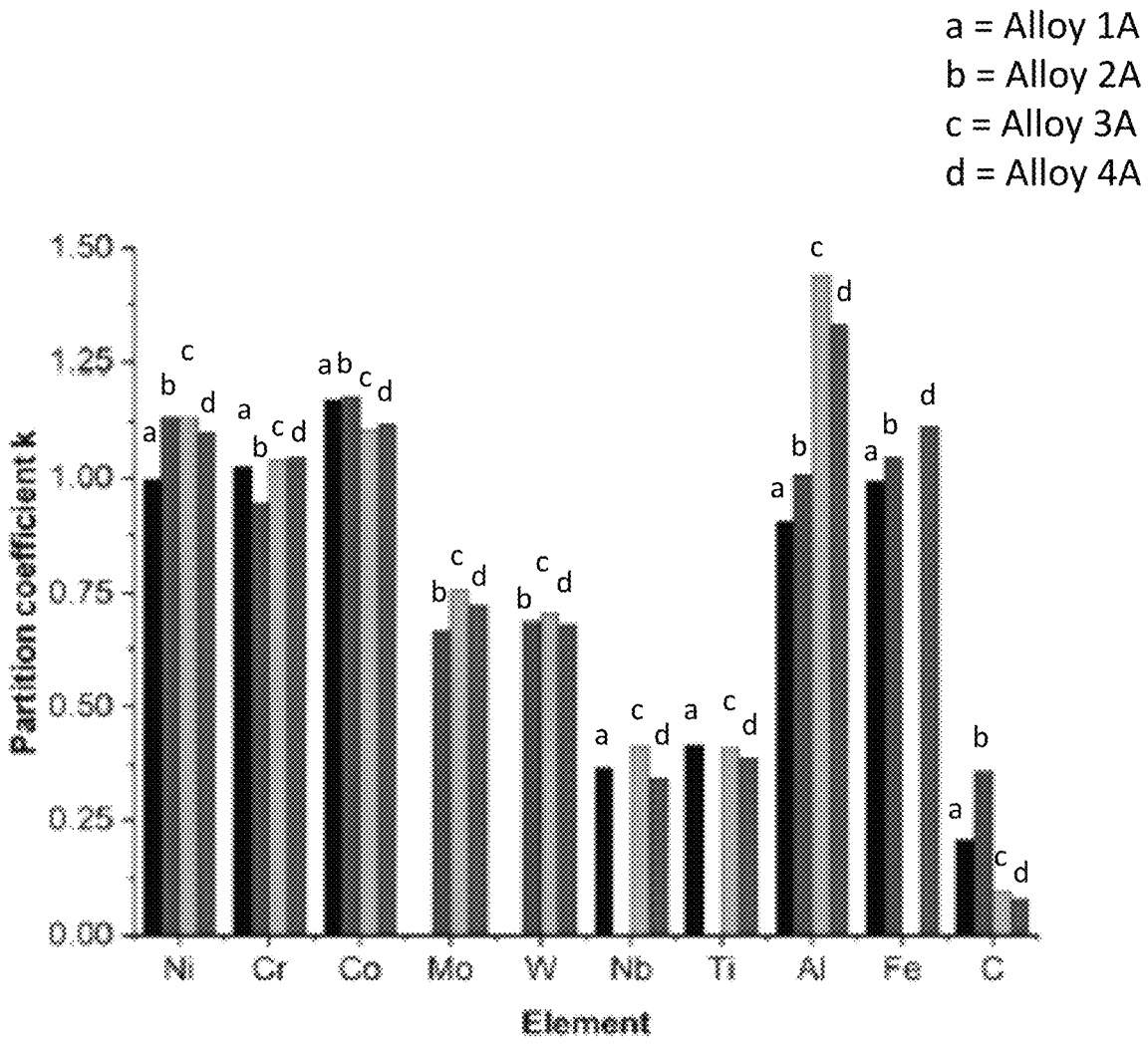
FIG. 9 is bar graph showing partition coefficients as calculated by Scheil-module in ThermoCalc® for certain representative alloy embodiments (Alloys 1A, 2A, 3A, and 4A).

In some embodiments, thermodynamic and kinetic analysis may be used to determine the partition coefficient of an alloy's constituent alloy elements. In some representative embodiments, thermodynamic and kinetic analysis utilizing Scheil-Guliver calculations may be used to determine the partition coefficient of an alloy's constituent alloy elements. In some representative embodiments, thermodynamic and kinetic modeling utilizing ThermoCalc® may be used to determine the partition coefficient of an alloy's constituent alloy elements. FIG. 9 displays the partition coefficient, k, for constituent alloy elements of representative Alloys 1A, 2A, 3A, and 4A, wherein the partition coefficient, k, is defined as the composition of the solid phase, $C_S$, over the composition of the liquid phase, $C_L$, or $k=C_S/C_L$. In some embodiments, such as those generating the data of FIG. 9, the Scheil-Guliver calculations are systems where the partition coefficient, liquidus lines, and solidus lines are linear. In some embodiments using a Scheil-Guliver calculation and for the case of the first fraction solid formed (that is, $f_s$=1%), an approximation can be made that $C_L$ is close to the nominal composition. According to FIG. 9, the constituent alloy elements, Ni, Cr, Co, Fe, and Al, in the four representative alloy embodiments alloys, are, to some degree, close to unity, suggesting very little tendency to segregate to either the liquid or solid phase, whereas Mo, W, and (more so, Nb, Ti and C) appear to segregate towards the secondary phases, thus enriching the liquid phase during the solidification process. Both Mo and W are can form secondary phases early on in the cooling process, as indicated by the Scheil plots, while Ti and Nb are highly likely to precipitate out together with C, thus very likely forming stable carbide phases at high temperatures.

Figure 10A:
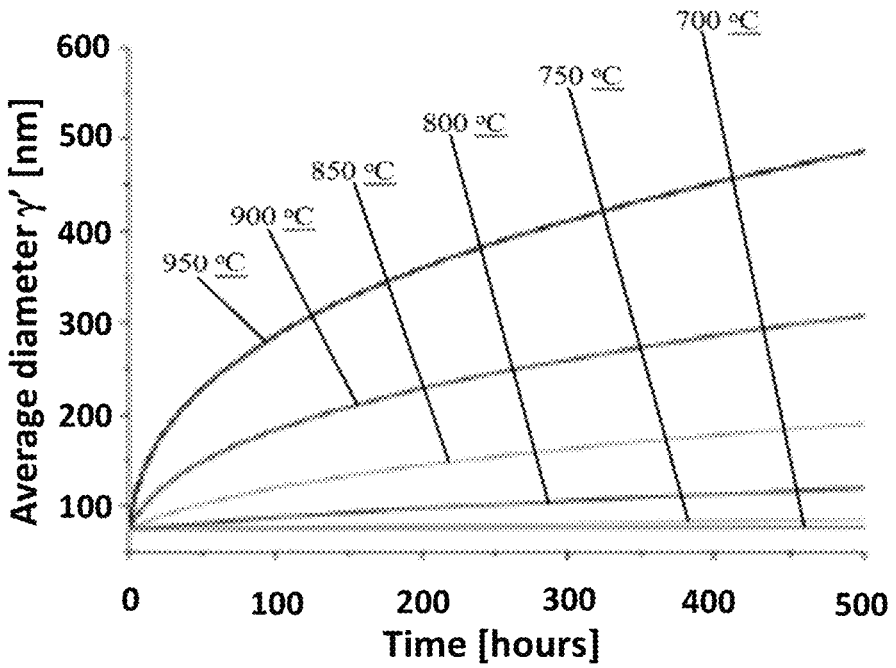
FIGS. 10A and 10B show results for Alloy 1A.
Figure 10B:
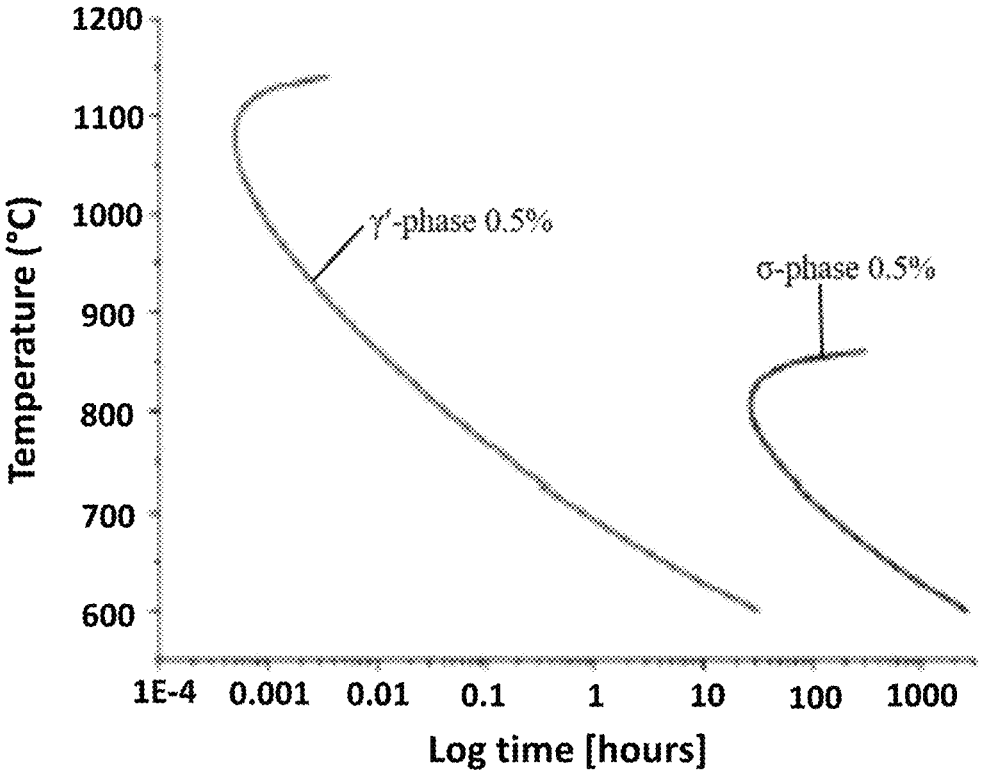

In some embodiments, thermodynamics and kinetics analysis may be used to determine the effect that subsequent treatments can have on an alloy (e.g., aging or other treatments). In some embodiments, thermodynamics and kinetics analysis may be used to determine the effect of such subsequent treatments on the microstructure of an alloy, including a secondary phase of an alloy and/or a size fraction of a secondary phase of an alloy. In some representative embodiments, thermodynamic and kinetics analysis utilizing the proprietary software JmatPro 6.0® may be used to evaluate the effect of aging treatment upon the size fraction of a secondary phase of an alloy. FIG. 10A displays a plot of time-dependent coarsening behavior of a representative alloy (Alloy 1A) at temperatures between 700° C. and 950° C. From 700° C. to 800° C., FIG. 10B displays negligible growth of secondary phases comprised in Alloy 1A. FIG. 10B displays a time-temperature-transformation (TTT) diagram of Alloy 1A. The TTT plot shown in FIG. 10B can be used to determine the time needed for the microstructure of the alloy to comprise 0.5% the γ' and σ secondary phases. TTT diagrams typically use 0.5% and 99% cutoffs to mark stability ranges for phases that will precipitate during isothermal holdings. The intersection of such a curve with straight line drawn from a specific heat-treat temperature on the y-axis allows one to evaluate the time used to trigger first precipitation when a line is extended straight down to the x-axis. Based on FIG. 10B, the σ-phase may not appreciably form for more than 130 hours, when holding at 700° C., whereas the γ'-phase forms after only 47 minutes at the same temperature.

Figure 11A:
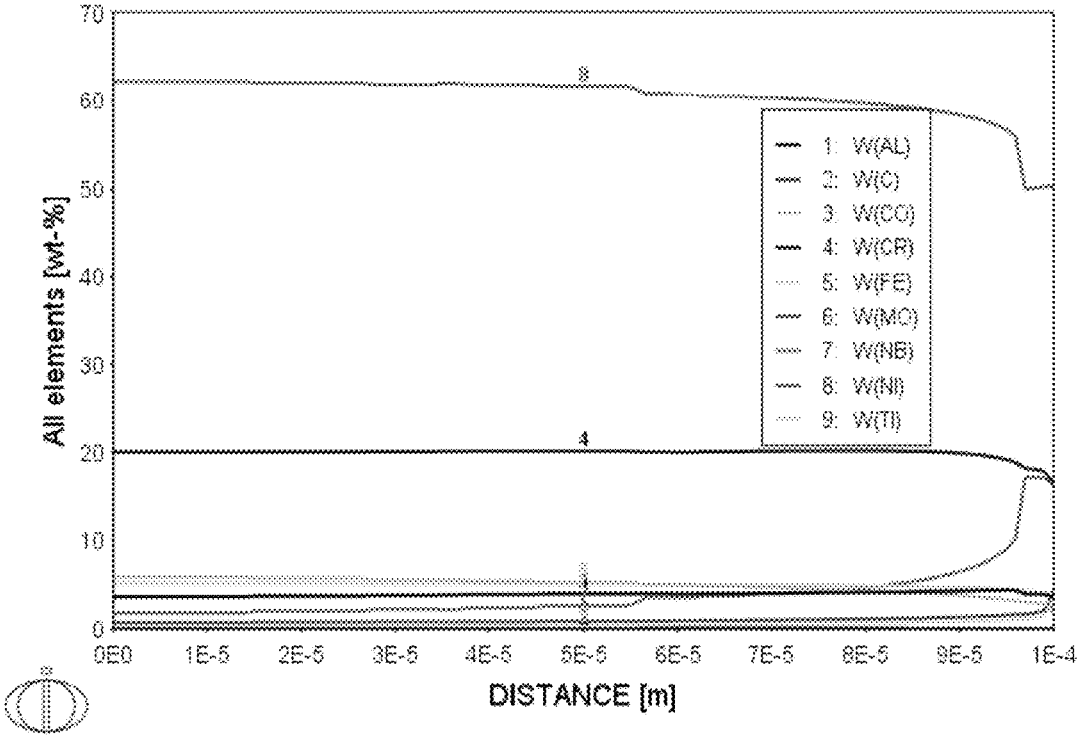
FIGS. 11A-11C are graphs showing homogenization treatment calculations at 1100° C. for 0 hours (FIG. 11A), 1 hours (FIG. 11B) and 4 hours (FIG. 11C) for Alloy 1A, based on Scheil solidification input data.
Figure 11B:
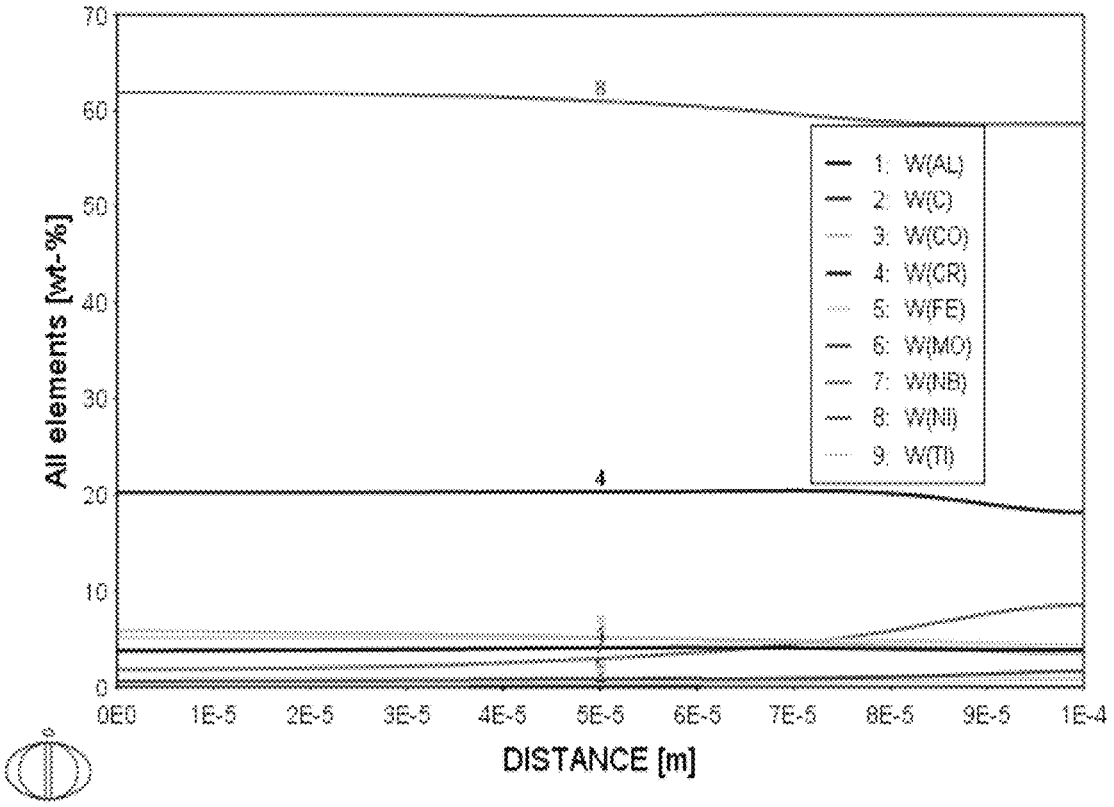
Figure 11C:
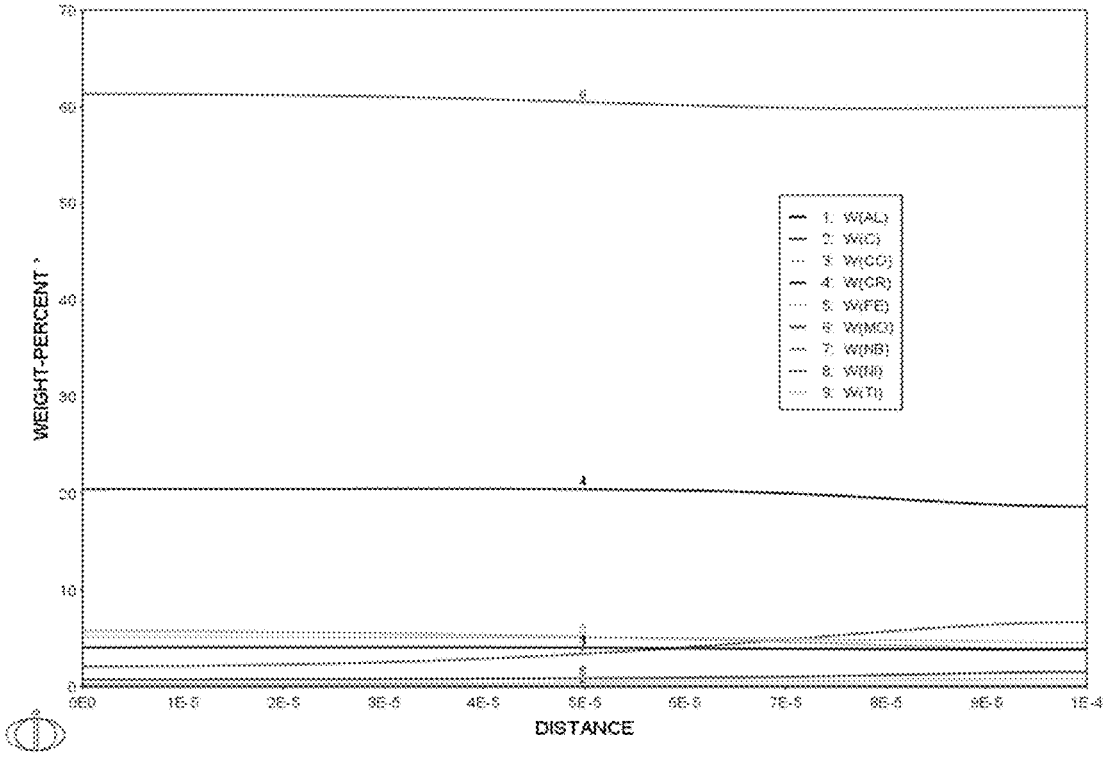
Figure 12:
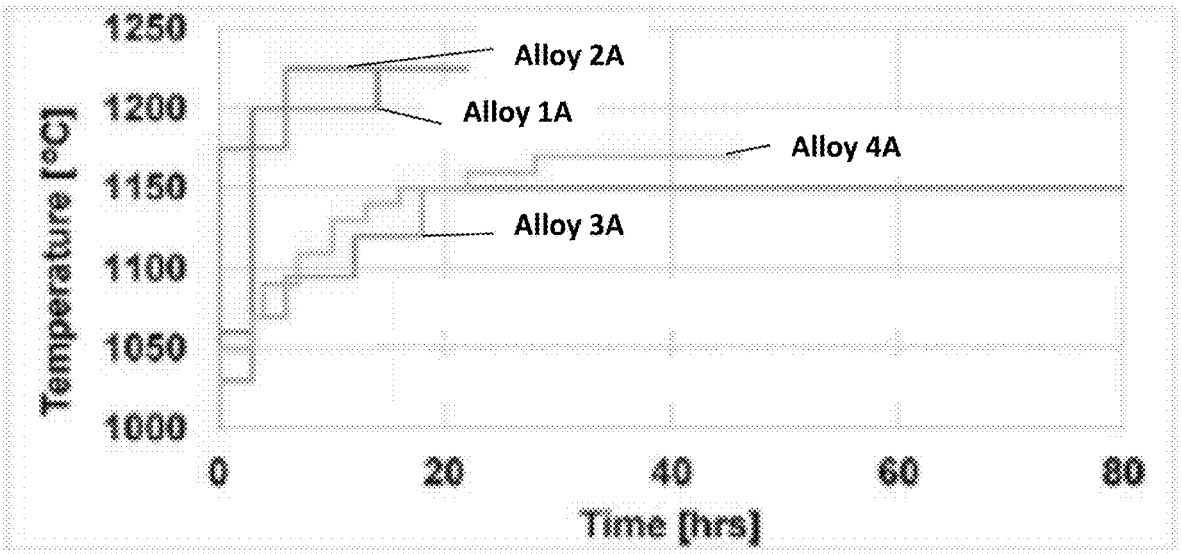
FIG. 12 shows homogenization treatment schedules for alloy embodiments based on Dicta® calculations for homogenizing the segregation profile in SDAS of 50 μm to 1%.

In some embodiments, thermodynamics and kinetics analysis may be used to determine the kinetics of homogenization at elevated temperatures. FIG. 11A-11C show exemplary homogenization calculations utilizing the Scheil-Guliver equation of the Alloy 1A at 1100° C. and at 0, 1, and 4 hours, respectively. The homogenization equations displayed in FIGS. 11A-11C indicate that Alloy 1A is essentially homogenized within an hour at 1100° C. In some embodiments, thermodynamics and kinetics analysis may be used to determine the kinetics of homogenization at each temperature of interest, whereby the homogenization kinetics are limited by the homogenization of the species that become solutionized at each step increase in temperature. Each homogenization step (time and temperature) will result in the decrease of the extreme points of the compositional spread, in turn bringing these areas closer to the mean composition and increasing the incipient melting point (or the lowest overall melting point). FIG. 12 displays the stepped-temperature homogenization behavior of representative Alloys 1A, 2A, 3A, and 4A. FIG. 12 shows decreased kinetics of homogenization at increased temperatures, due to an increase in incipient melting temperature caused by reducing local chemical gradients and gradually destabilizing higher-melting secondary phases.

In some embodiments, determining the initial composition of constituent alloy elements may be utilized to predict a set of properties of the alloy. In some embodiments, the alloy may be subjected to at least one subsequent treatment, which can affect the set of properties of the alloy. Non-limiting examples of subsequent treatments include solution treatment, aging, strain hardening, homogenization, and forming a scale or protective coating. The set of properties of a solid metallic material may include, but are not limited to, properties of a microstructure of the alloy, which can be using thermodynamic and/or kinetic analysis. This set of properties can include, but is not limited to, the presence and fraction of one or more secondary phases, the chemical composition of one or more phases of the solid metallic material, the type of one or more secondary phases, a solvus temperature of a secondary phase, or combinations thereof.

In some embodiments, the effect upon a set of properties of the alloy using the at least one subsequent treatment may be evaluated using thermodynamic and/or kinetic analysis. In some independent embodiments, simulations of an alloy that has been subjected to at least one subsequent treatment may be used to guide the conditions used in the subsequent treatment. Solely by way of example, simulating an equilibrium plot of an alloy can be used to determine the solvus temperature of at least one phase within the microstructure of the alloy. Calculated solvus temperatures can provide information to conduct a subsequent treatment above or below that value to dissolve or preserve a secondary phase during the subsequent treatment. In another example, homogenization simulations may inform the particular temperature and time period to utilize during a homogenization treatment. In yet another example, simulating a TTT diagram of the alloy may inform the practitioner of the temperature and time period to utilize while aging to cause coarsening of specific secondary phases.

A representative list of mechanical properties of an alloy that also may be evaluated when determining the process to use when making the alloy includes yield strength, tensile strength, creep rupture, and ductility. In some embodiments, a simulated true stress—true strain plot may be used to calculate mechanical properties. Provided that the calculations and/or determinations of a set of properties of the alloy satisfies a target set of properties, the alloy can then be fabricated; however, if calculations fail to satisfy a target set of properties, the initial composition of constituent alloy elements may be modified and/or the type and/or conditions of one or subsequent treatment used to make the alloy may be modified.

V. Overview of Several Embodiments

Disclosed herein are embodiments of an alloy, comprising: greater than 0 wt % to 80% nickel; greater than 0 wt % to 30% chromium; greater than 0 wt % to 25% cobalt; greater than 0 wt % to 10% aluminum; and greater than 0 wt % to 1% carbon. In some embodiments, the alloy does not comprise: (i) 16 wt % Cr, 4.5 wt % Al, 3.5 wt % Fe, 0.05 wt % C, 0.01 wt % B, 0.2 wt % Mn, 0.1 wt % Si, 0.01 wt % Y, 0.02 wt % Zr, and a balance wt % made up of Ni and trace impurities; (ii) 22 wt % Cr, 5 wt % Co, 2 wt % Mo, 14 wt % W, 0.3 wt % Al, 3 wt % Fe, 0.1 wt % C, 0.015 wt % B, 0.5 wt % Mn, 0.4 wt % Si, 0.02 wt % La, and a balance wt % made up of Ni and trace impurities; (iii) 25 wt % Cr, 20 wt % Co, 0.5 wt % Mo, 2 wt % Nb, 1.8 wt % Ti, 0.9 wt % Al, 0.7 wt % Fe, 0.03 wt % C, 0.3 wt % Mn, 0.5 wt % Si, and a balance wt % made of Ni and trace impurities; (iv) 20 wt % Cr, 8 wt % Mo, 3.15 wt % Nb, and a balance wt % made up of Ni and trace impurities; (v) 23 wt % Cr, 1 wt % Co, 10 wt % Mo, 4.15 wt % Nb, 0.4 wt % Ti, 0.4 wt % Al, 5 wt % Fe, 0.1 wt % C, 0.5 wt % Mn, 0.5 wt % Si, 0.015 wt % P, 0.015 wt % S, and a balance wt % made of Ni and trace impurities; or (vi) 25 wt % Cr, 3 wt % or less Co, 2.5 wt % or less Mo, 0.7 wt % Nb, 0.1 wt % Al, 37 wt % Ni, 0.03 wt % C, 0.7 wt % Mn, 0.6 wt % Si, 0.2 wt % N, 0.05 wt % C, 0.004 wt % B, and a balance wt % made of Fe and trace impurities.

In any or all of the above embodiments, the alloy can further comprise greater than 0 wt % to 20% Mo, greater than 0 wt % to 20% W, greater than 0 wt % to 5% Ti, greater than 0 wt % to 15% Fe, greater than 0 wt % to 1% B, greater than 0 wt % to 5% Mn, greater than 0 wt % to 5% Si, greater than 0 wt % to 1% Cu, greater than 0 wt % to 1% P, greater than 0 wt % to 1% S, greater than 0 wt % to 10% niobium, or any and all combinations thereof.

In any or all of the above embodiments, the alloy comprises 34 wt % to 75 wt % Ni.

In any or all of the above embodiments, the alloy comprises 15 wt % to 30 wt % Cr.

In any or all of the above embodiments, the alloy comprises 5 wt % to 18 wt % Co.

In any or all of the above embodiments, the alloy comprises 0.5 wt % to 4 wt % Nb.

In any or all of the above embodiments, the alloy comprises 0.05 wt % to 5 wt % Al.

In any or all of the above embodiments, the alloy comprises 0.02 wt % to 0.5 wt % C.

In any or all of the above embodiments, the alloy comprises 5 wt % to 10% Mo, 5 wt % to 10% W, 0.5 wt % to 4% Ti, 0.5 wt % to 4% Fe, 0.001 wt % to 0.02% B, greater than 0 wt % to 2% Mn, greater than 0 wt % to 2% Si, greater than 0 wt % to 1% Cu, greater than 0 wt % to 0.1% P, greater than 0 wt % to 0.1% S, 0.5 wt % to 4% niobium, or any and all combinations thereof.

In any or all of the above embodiments, the alloy has a microstructure comprising at least one secondary phase.

In any or all of the above embodiments, the at least one secondary phase comprises precipitates.

In any or all of the above embodiments, the microstructure comprises phase having a grain size of 50 μm to 150 μm.

In any or all of the above embodiments, the microstructure comprises a substantially uniformly distributed γ'-phase, a carbide-containing phase, or a combination thereof.

In any or all of the above embodiments, the alloy has an exterior surface and the exterior surface is oxidized.

In any or all of the above embodiments, the exterior surface is carburized.

Also disclosed herein are embodiments of a method for making an alloy of the present disclosure, wherein the method comprises: determining a set of properties for the alloy; determining an initial composition of constituent alloy elements of the alloy; calculating the set of properties for the initial composition of the alloy using thermodynamic and kinetic analysis; and fabricating the alloy.

In some embodiments, the alloy is configured for use with a supercritical fluid.

In any or all of the above embodiments, the method further comprises altering the initial composition of constituent alloy elements if the alloy fails to satisfy the set of properties for a solid metallic material as evidenced by substantial cracking and/or fracturing of the alloy.

In any or all of the above embodiments, the set of properties of the alloy comprises a solvus temperature, a liquidus temperature, a solidus temperature, or a combination thereof of a secondary phase of alloy.

In any or all of the above embodiments, the set of properties of the alloy comprises a partition coefficient of the alloy, a yield strength of the alloy, a tensile strength of the alloy, a creep rupture stability of the alloy, or any combination thereof.

In any or all of the above embodiments, the method can further comprise determining at least one subsequent treatment to which the alloy can be subject to improve the set of properties.

In any or all of the above embodiments, the at least one subsequent treatment comprises solution-treating the alloy, homogenizing the alloy, aging the alloy, strain-hardening the alloy, forming a protective coating on the alloy, or any combination thereof.

In any or all of the above embodiments, the method can comprise exposing the alloy to the at least one subsequent treatment.

In any or all of the above embodiments, the method can further comprise analyzing a microstructure of the alloy using scanning electron microscopy (SEM), scanning electron microscopy-back scattered electron imaging (SEM-BSE), secondary-electron imaging (SE), transmission electron microscopy (TEM), selected area diffraction (SAED), high resolution X-ray diffraction (XRD), energy-dispersive X-ray spectroscopy (EDX), electron energy loss spectroscopy (EELS), or any combination thereof.

In any or all of the above embodiments, the method can further comprise exposing the alloy to a supercritical fluid and measuring corrosion resistance of the alloy.

In any or all of the above embodiments, measuring corrosion resistance of the alloy comprises measuring a change in mass following exposure of the alloy to the supercritical fluid.

Also disclosed herein are embodiments of a method for fabricating a nickel-based alloy, comprising: determining a set of properties for the nickel-based alloy; determining an initial composition of constituent alloy elements of the nickel-based alloy; calculating the set of properties selected from a partition coefficient of the alloy, a yield strength of the alloy, a tensile strength of the alloy, a creep rupture stability of the alloy, or any combination thereof for the initial composition of the nickel-based alloy using thermodynamic analysis, a kinetic analysis, or a combination thereof; fabricating the nickel-based alloy; subjecting the nickel-based alloy to at least one subsequent treatment selected from homogenization, aging, strain-hardening, solution-treating, protective coating formation, or combinations thereof at a particular temperature, treatment time period, applied stress, or combinations thereof; analyzing a microstructure of the nickel-based alloy using scanning electron microscopy (SEM), scanning electron microscopy-back scattered electron imaging (SEM-BSE), secondary-electron imaging (SE), transmission electron microscopy (TEM), selected area diffraction (SAED), high resolution X-ray diffraction (XRD), energy-dispersive X-ray spectroscopy (EDX), electron energy loss spectroscopy (EELS), or any combination thereof; analyzing at least one mechanical property of the nickel-based alloy; and exposing the nickel-based alloy to a supercritical fluid; wherein calculating the set of properties using thermodynamics analysis, kinetics analysis, or combinations thereof is conducted utilizing the Scheil-Gulliver equation and utilizing computer-aided software to generate a solidification plot, an equilibrium plot, a coarsening plot, a stress-strain plot, a partition coefficient, a simulated homogenization treatment, a simulated binding energy, or combinations thereof.

VI. Examples

Example 1

FIG. 2 shows some representative ingots (comprising representative Alloys 1A, 2A, 3A, and 4A) initially fabricated using a VAR system. Table 2 provides the target weight and the actual final weight for the ingots of these alloy embodiments. Without being limited to a particular theory, it currently is believed that any losses in mass are attributed to vaporization and any mass gains are attributed to oxidation or other contamination. As shown by Table 3, the mass deviations of the experimental alloys are well within ±1% of the target weight.

TABLE 3

| | Alloy 1A | Alloy 2A | Alloy 3A | Alloy 4A |
|---|---|---|---|---|
| Target weight [g] | 100 | 100 | 100 | 100 |
| Final weight [g] | 100.077 | 99.656 | 101.315 | 100.569 |

Table 4 provides an outline of an exemplary fabrication method wherein the initial height and diameter of the alloy was 6.103 and 2.82, respectively. The method used a constant reheat temperature of 1200° C.

TABLE 4

| Mill setting height [in] | Reheat time [min] | Reduction of area [%] |
|---|---|---|
| 2 | 15 | 29 |
| 1.625 | 15 | 42 |
| 1.25 | 15 | 56 |
| 1.063 | 12 | 62 |
| 0.904 | 12 | 68 |
| 0.768 | 12 | 73 |
| 0.653 | 10 | 77 |
| 0.555 | 10 | 80 |
| 0.472 | 7 | 83 |
| 0.401 | 7 | 86 |

Figure 13A:
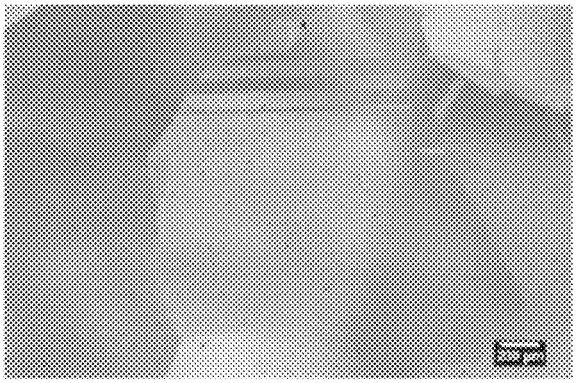
FIGS. 13A and 13B show the microstructure of Alloy 1A, after homogenization, as a high-contrast overview (FIG. 13A) and an image showing the matrix background with γ' precipitates (FIG. 13B).
Figure 13B:
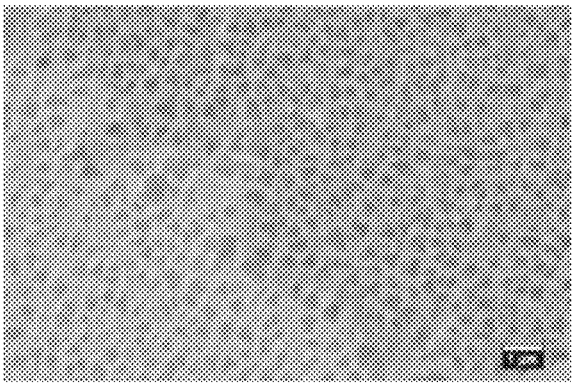

After performing a homogenization step, samples were cut into quarter sections, and then subsequently hot-mounted and polished to a 0.04 μm finish. Scanning electron microscopy was used to evaluate the microstructures after homogenization with regards to the dissolution of cast structures, any inhomogeneities, and chemical segregation. For representative Alloy 1A (see FIGS. 13A and 13B), a high contrast setting in backscatter mode is used to highlight any remaining chemical variations across grains. Some segregation is still faintly visible, suggesting minor but negligible variations. At the same time, the up-close microstructure in the matrix contains few constituents, mainly inclusions, seen as black spheres in FIG. 13A, which can be identified as $SiO_2$, Ti(C,N) and $Al_2O_3$. The matrix itself, shows, upon higher magnification, jagged, semi-cuboidal structures, which turned out to be γ', most likely secondary γ', assuming full dissolution during the homogenization cycle. The area fractions measured, for the amount of γ' present, were 19% at an average size of 0.15 μm±0.019 μm.

Figure 14A:
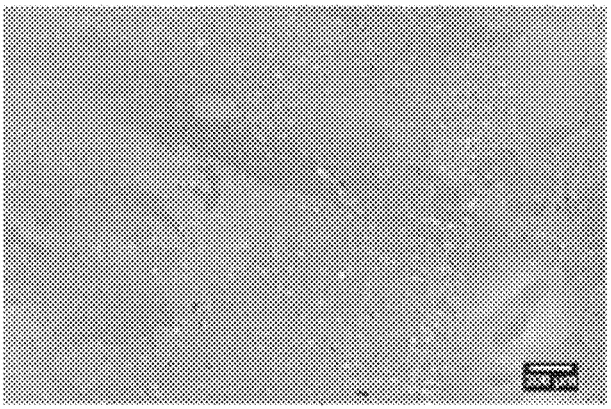
FIGS. 14A and 14B show the microstructure of Alloy 2A, after homogenization, as a general matrix overview (FIG. 14A) and an image showing the grain structure and the matrix background with precipitate phases (FIG. 14B).
Figure 14B:
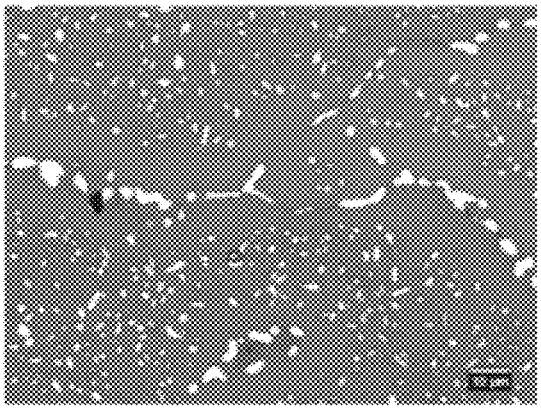

Analysis of representative Alloy 2A showed a more complex microstructure after homogenization than representative Alloy 1A, which is likely is attributed to the increased amounts of transition-metal elements that are heavily segregating, Mo and W at 5 wt % and 15 wt %, respectively. At low magnifications, the general microstructure showed still signs of directional solidification, with considerable remnants from the cast structure (see FIG. 14A). The grains that have formed, as well as the prior dendrite boundaries, are lined with a nearly continuous network of phases, all appearing to be heavier than the matrix, based on their high-contrast response in backscatter mode. Upon higher resolution (see FIG. 14B), the intragranular and intradendritic areas show precipitates of similar Z-contrast, which are uniformly distributed, sizes between 1-4 μm. Chemical analysis of these phases indicate that both types of precipitates are indeed similar in composition, suggesting a W—Ni—Cr—(Mo,Co) phase, which likely has a γ-phase type with a stoichiometry of $(Cr_{0.23}W_{0.26}Mo_{0.15})(Ni_{0.25}Co_{0.05})$. Based on equilibrium and Scheil-Guliver calculations, this phase may precipitate out of the liquid and have stability close to the Liquidus temperature. Its area size fraction was calculated to be 9.44%.

Figure 15A:
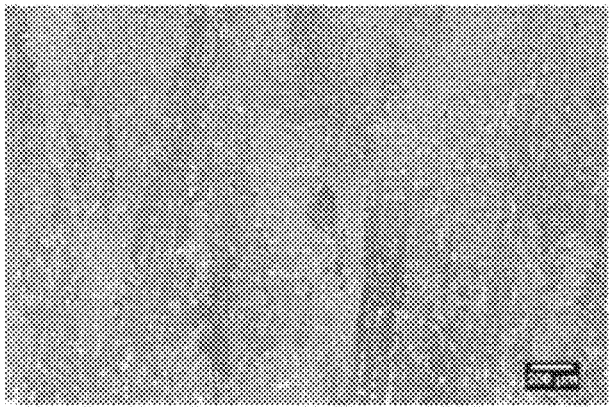
FIGS. 15A and 15B show the microstructure of Alloy 3A, after homogenization, and further shows the grain and dendritic structure (FIG. 15A) and the boundary between two prior dendrites (FIG. 15B).
Figure 15B:
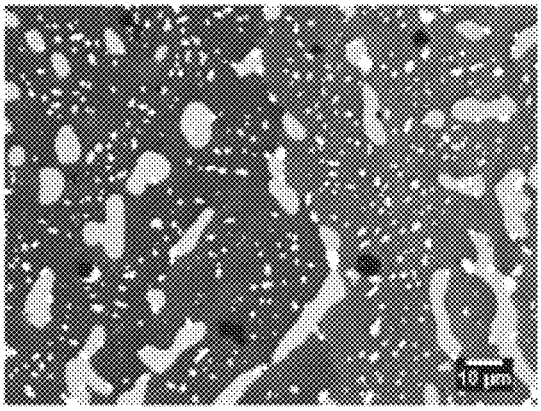

Representative Alloy 3A shows an even more segregated microstructure, resembling more an as-cast structure (see FIGS. 15A and 15B). The high-contrast backscatter mode highlights the stronger chemical gradient as well as the interfaces between the prior dendrites, which are still showing significant remnants of the dendrite branches and interdendritic spaces. This can be seen in more detail in FIG. 15B, where the secondary phases, which precipitated out of the melt, are also apparent. In contrast to Alloy 2A, Alloy 3A has Ti and Nb added, more Cr and less Al, and a Ti/Al-ratio of 2:1, favoring stable γ'-formation. This prevented the formation of the same α-W network, and instead favored a similarly shaped extensive network of precipitate phases, that were identified as μ-phases of the $(Cr_{0.45}Mo_{0.08}W_{0.1})(Ni_{0.3}Co_{0.06})$ kind. The second phase, appearing white and more evenly distributed in the background, appears to be another kind of μ-phase, resembling the one found in Alloy 2A, adjusted for the higher Cr amounts and the reduced amounts of transition metal elements available. The stoichiometry found is rather shifted towards $(Cr_{0.3}Mo_{0.11}W_{0.21})(Ni_{0.27}Co_{0.07})$. The average size fraction for the larger grey μ-phase was estimated at 12.6% with an average size 42.663 $\mu m^2$, and the smaller white phase at 4.5% with an average size of 1.477 $\mu m^2$.

Figure 16A:
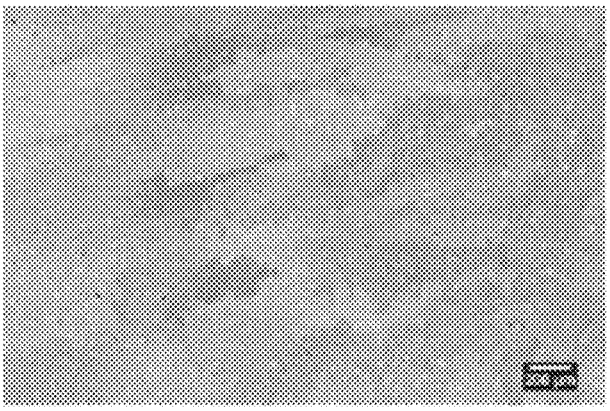
FIGS. 16A and 16B show the microstructure of Alloy 4A, after homogenization, and further shows the grain and dendritic structure (FIG. 16A) and the boundary microstructures (FIG. 16B).
Figure 16B:
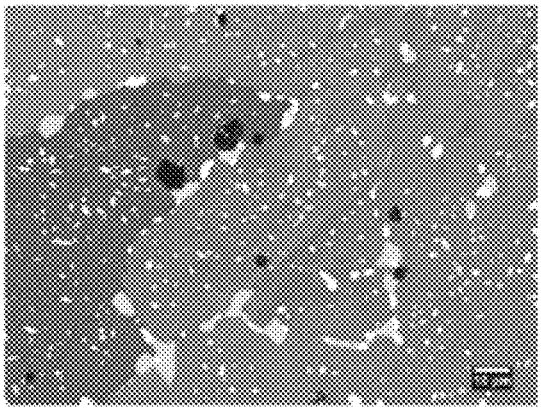

Alloy 4A presents a similar microstructure to Alloy 3A, as remnants of the cast structure are still present, and the prior dendrites and dendrite arms are still faintly visible (see FIGS. 16A and 16B). Boundaries are visible between dendrite cores and interdendritic areas, as well as newly formed grains, where there is a network of discontinuous phases, which resembles Alloy 2A more than Alloy 3A. This phase appears grey in contrast and has the composition $(Cr_{0.45}Mo_{0.08}W_{0.1})(Ni_{0.3}Co_{0.06})$, which is similar to the first μ-phase found in Alloy 3A. Without being limited to a single theory, it currently is believed that the difference between both μ-type phases can be explained by the shifted Co/W-ratios between both alloys, with Alloy 4A having a 1:1 ratio, while Alloy 3A has a ratio of 1:3. In Alloy 4A, these phases are present at roughly 2% with an average size of 19.041 $\mu m^2$. There is also a finer, more uniformly distributed white phase within the prior dendrite area that can also be identified as μ-phase with the stoichiometry $(Cr_{0.29}Mo_{0.11}W_{0.2})(Ni_{0.24}Co_{0.11})$, which is similar to the comparable high-W μ-phase found in alloy 3-A. Its size fraction is estimated at 3.767% with an average size of 1.21 $\mu m^2$.

From the measurements taken in the as-homogenized condition, provided by Table 5, below, it is clear that there are strong influences of the base chemistry of the representative alloys discussed above on the chemical homogeneity and stability of the precipitated phases. The existence of these phases is somewhat contradictory to a successful homogenization treatment, which usually is designed to eliminate these types of phases and may possibly be explained by allowing secondary phases to form during the cooling process. Additional heat treatments of these structures could lead to further exacerbated segregation phenomena by uphill-diffusion enhanced formation of low-melting Ni—Mo eutectics, which may be attributed to stepwise increase of temperature in the field between solvus and solidus, while a gradual temperature increases from solvus to final temperature appeared more beneficial.

TABLE 5

| Phase [at-%] | Cr | Ni | W | Co | Mo |
|---|---|---|---|---|---|
| $\mu_I$ (Alloy 3A, 4A) | 45 | 26-30 | 9-10 | 6-10 | 7-9 |
| $\mu_{II}$ (Alloy 3A, 4A) | 29-30 | 24-27 | 20-21 | 7-11 | 11 |
| $\mu_{III}$ (Alloy 2A) | 23 | 25 | 26 | 5 | 15 |
| Transition phase in Haynes 230 [11] | 46.93-47.35 | 38.53-41.48 | 9.27-10.3 | | 1.9-4.24 |
| μ or $M_6C$ in C-22 [13] | 24.73 | 53.16 | | | 22.11 |
| μ in C-276 [17] | 16.19 | 36.51 | 3.12 | 1.95 | 49.5 |
| $M_6C$ in C-276 [17] | 20.83 | 34.84 | 2.06 | 1.93 | 27.49 |
| σ in alloy 800 [40] | 54 | 22 | 5 | 12 | 6 |

Example 2

As-wrought, as-wrought and aged, and solution treated samples were analyzed and compared regarding their general microstructural makeup, grain size and evolution of the γ'-phase. The goal for the solution treatment was to assess, whether an additional heat-treatment after hot-working would have an impact on the microstructure and, further, on the mechanical properties. The same goals applied to the aging treatment, but in addition, the γ'-coarsening behavior was investigated, and compared with the as-wrought and solution-treated samples.

The aging treatment was conducted at a temperature of 700° C. for 200 hours in ambient still air in a Leco tube furnace, followed by air-cooling. Temperature control was performed with a type-K thermocouple. The temperature was in congruence with $sCO_2$ test temperatures. The solution treatment was conducted at 1150° C. for 15 min in still air in a Thermcraft box furnace, followed by air-cooling. Temperature control was performed with two type-R thermocouples as part of an integrated PID loop for accurate temperature control. All heat-treated samples were hot-mounted in conductive resin and mechanically ground and polished to 0.04 μm surface finish, followed by ultrasonic cleaning in methanol. Surface characterization was performed using a Zeiss Sigma SEM at 15 kV, using secondary electron (SE) and backscatter electron (BSE) detectors, while chemical microanalysis was performed using an Oxford Instruments EDS detector. Statistical image analysis on SEM images for particle and grain size analysis was performed using ImageJ2.

Figure 17A:
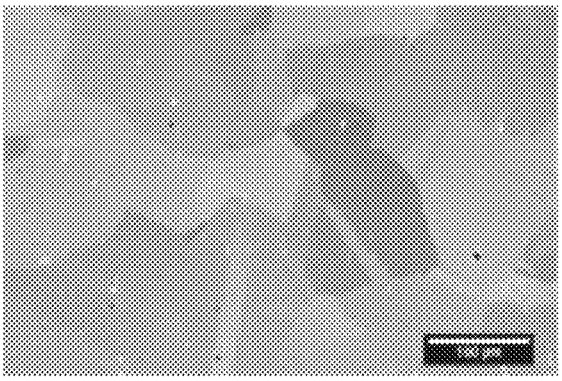
FIGS. 17A-17C are SEM-BSE images of cross-sections of Alloy 1A showing the general matrix for as-wrought (FIG. 17A), solution-treated (FIG. 17B), and aged specimens (FIG. 17C).
Figure 17B:
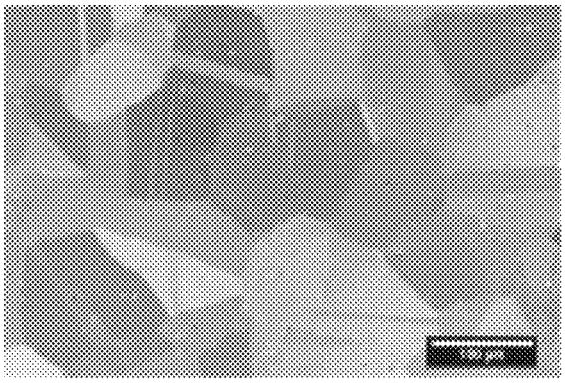
Figure 17C:
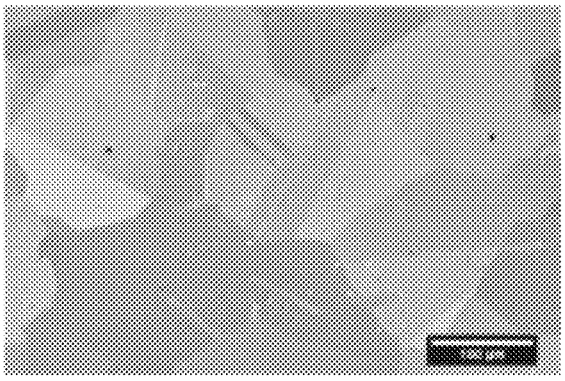

The phase diagram calculated for Alloy 1A, with Thermo-Cale® 2017a, using the TCNi7 database, is shown in FIG. 8A. It suggests that, after successful homogenization and solution heat-treatment, all secondary phases except the MC-type carbide should be in solution. For comparison, the expected phases that occur during solidification are presented in FIG. 7A. In the case of the as-wrought specimens, it was assumed that, while the Laves and BCC-type phase dissolved during hot-working, some of γ'-phase may still be present due to the slow cooling of the final plate material. Since the phase stability for the γ'-phase ends at around 1100° C., the solution treatment temperature was set at 1150° C., with a holding time of 15 min, in order to minimize excessive grain growth. These modeling results were compared with the characterization results for the as-wrought, solution-treated and aged specimens. The matrix overview images for all samples as taken in SEM-BSE mode are shown in FIGS. 17A-17C. In general, all three conditions showed a similar microstructure, showing large austenite grains, and two obvious phases present. These were a white, irregularly-shaped, phase, found to be Nb-carbides, and, less commonly, a black, blocky phase, found to be Ti—Nb-carbides. Further, upon higher magnification, for all three conditions, uniformly distributed γ'-phase was found. The statistical image analysis, seen in Table 6, showed that the solution treatment was effective in starting to dissolve the γ'-phase, but required additional time to complete the process. The average matrix grain size notably decreased during the solution treatment. This can be attributed to both short holding times, where large grain growth could be minimized, and recrystallization effects that allowed for smaller grains to nucleate and grow. The aging treatment, in turn, showed no significant effect on the γ' average size, while slightly increasing its volume fraction.

TABLE 6

| Sample | γ' vol. fraction [%] | γ' avg. size [nm] | Grain size avg. [μm] | Grain size SD [μm] |
|---|---|---|---|---|
| As-wrought | 15 | 75 | 115 | 45 |
| ST | 13 | 30 | 75 | 33 |
| As-wrought and aged | 20 | 75 | 87 | 51 |

Figure 18A:
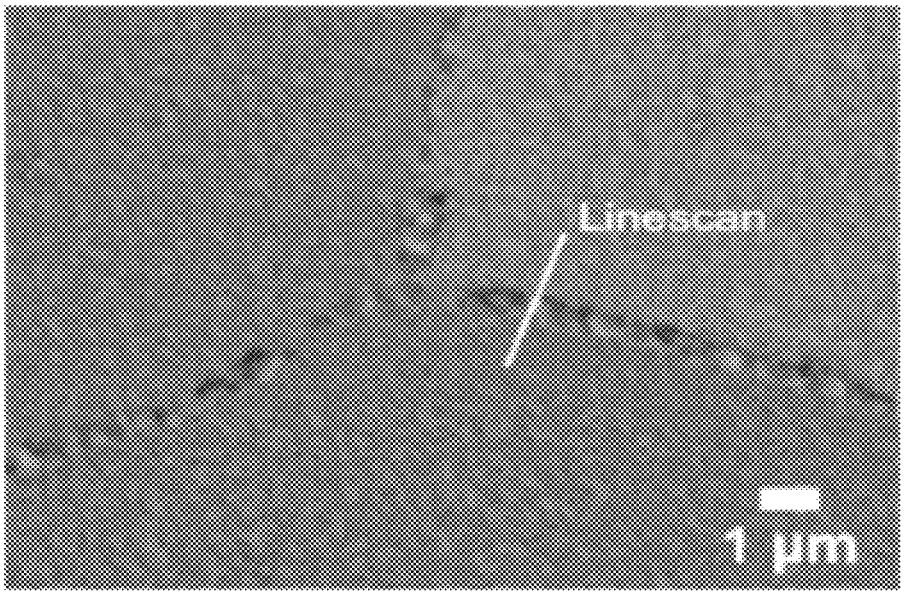
FIGS. 18A and 18B show data concerning the triple grain boundary of aged Alloy 1A, showing precipitation at the grain boundary (FIG. 18A) and EDS linescan (FIG. 18B) across grain boundary as indicated in FIG. 18A.
Figure 18B:
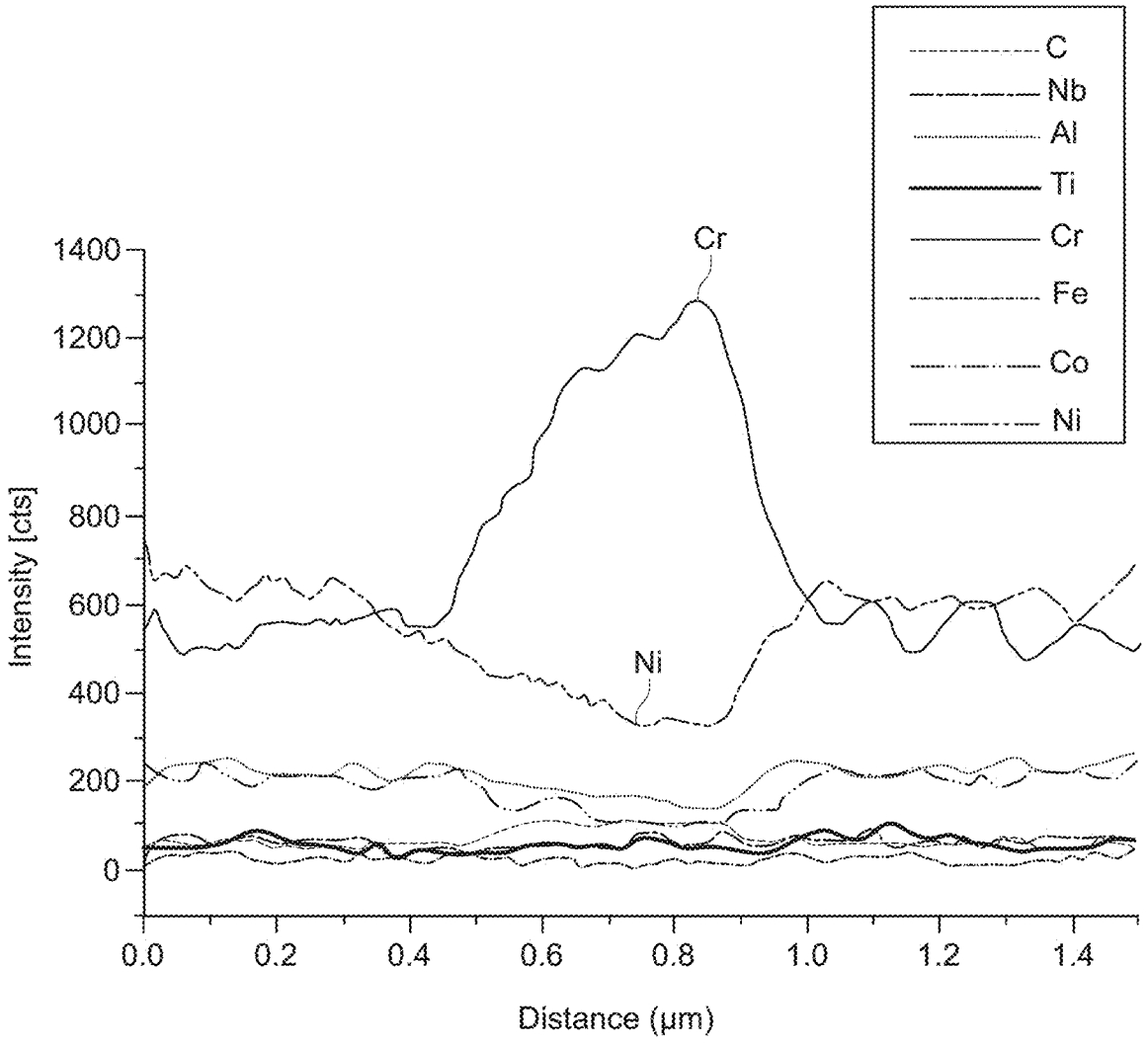

The response of the aging treatment on the average γ' size was compared to the thermodynamic modeling results of Alloy 1A, based on the measured matrix grain size of the as-wrought specimens. In FIG. 10A, the coarsening behavior of Alloy 1A has been modelled in JmatPro 6.08 and plotted against time for a range of temperatures. Comparing with the curve for 75° C., the measured results show good agreement, as negligible growth is predicted for all temperatures below 750-800° C. The general precipitation behavior of γ' was also modelled in a Time-Temperature-Transformation (TTT) diagram in FIG. 10B. Here, the thermodynamically stable phases are modeled for a wide temperature range, taking kinetic influences into account, based on holding time and temperature. It can be seen that the δ-phase, as predicted from equilibrium calculations, is not expected to form for more than 130 h, when holding at 700° C. At the same time, γ' is predicted to form after only 47 min at temperature. Indeed, high-resolution BSE images of the aged specimen show γ' precipitation at the grain boundaries, seen in FIGS. 18A and 18B. Chemical analysis using EDS suggests substantial Cr enrichment and depletion of Ni, and minor enrichment for all other alloying elements.

Example 3

Thermo-mechanical testing in a Gleeble 3500® unit was performed to study the response of the as-wrought Alloy 1A to hot-deformation processing conditions, as seen during manufacturing of final shapes such as heat-exchanger coils and tubes. The temperature ranges selected were similar to the hot-working temperatures the alloy experienced during initial hot-rolling. Using hot compression testing, the influence of different strain rates and temperatures for a true strain of 0.7 is analyzed, as well as the effect of prior additional solution treatment. The strain rates used are, 1.0/s and 0.1/s, for temperatures between 900° C. and 1200° C. in 50° C. increments. Comparisons are made between the different testing conditions and with modeling results for flow-stress using JmatPro 6.0®.

Figure 19:
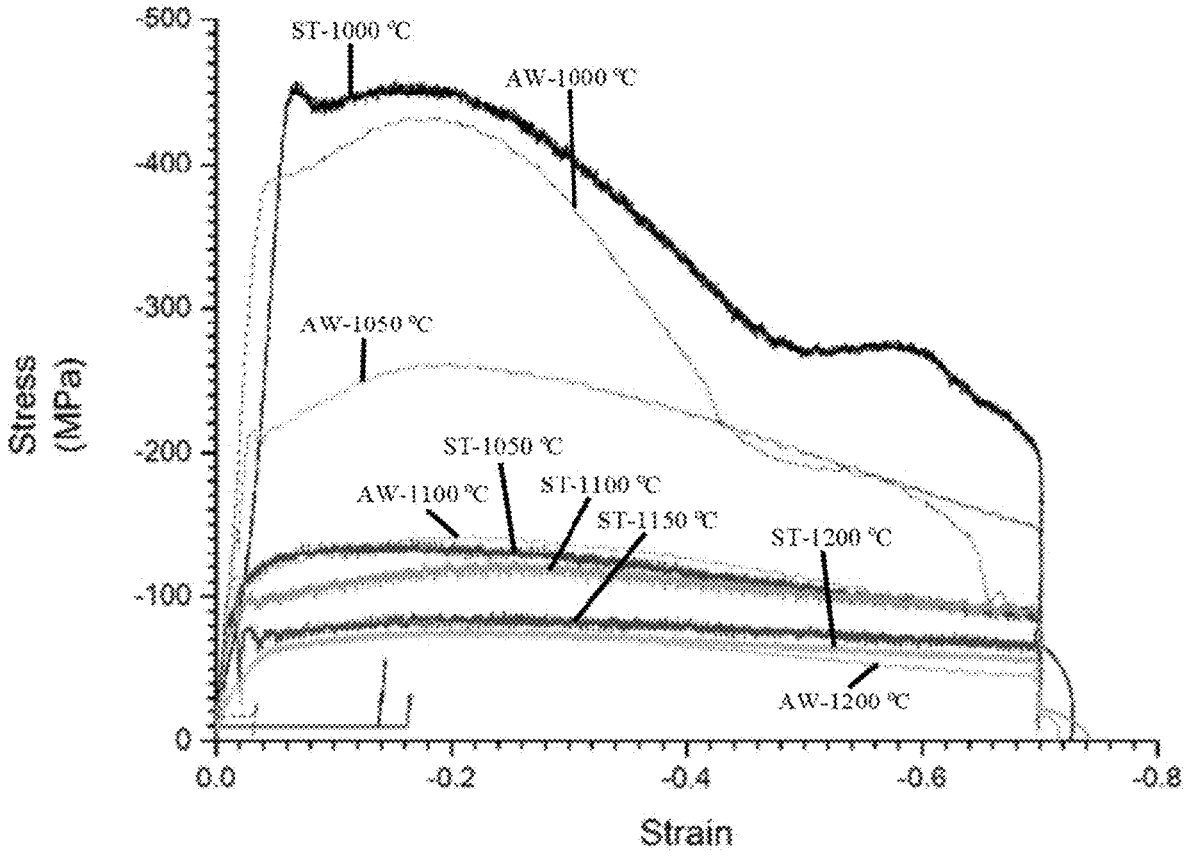
FIG. 19 is a true stress true strain plot showing results at different temperatures for as-wrought and solution-treated embodiments of Alloy 1A.

In FIG. 19, the flow-stress results for Alloy 1A in the as-wrought and solution-treated conditions are shown. Notably, the results for 900° C. are missing, which is due to severe, complete fracturing and material degradation at this temperature, for all strain rates and heat-treat conditions. As temperatures increase, the cracking susceptibility decreased, while samples exposed at 1000° C. all fractured, which occurred for both heat-treat conditions, at around the same true strain of ε=0.45. However, from temperatures of 1050° C. and higher, no fracturing or cracking could be observed anymore. Beyond that, all samples show rather common flow stress behavior, for austenitic alloys with low stacking fault energies. This is indicated here by a strong yield-point-temperature dependence and relatively low temperature-strain hardening dependence. Further, the characteristic onset of dynamic recrystallization is visible, indicated by a peak in the flow stress before the strain hardening becomes negative and the curve drops. This is evidently more notable for the as-wrought samples than for the solution-treated ones, e.g. at 1050° C. and 1000° C. The reason can be, that the microstructure after hot-rolling retained some inhomogeneities or phases, which did not dissolve or even precipitated during hot-rolling. These then can become nucleation sites for an earlier, more pronounced onset of dynamic recrystallization. This is also likely the reason for a generally higher flow stress for the as-wrought samples. The larger average γ' size as compared to the solution-treated samples is likely to increase flow-stress as well.

Figure 20A:
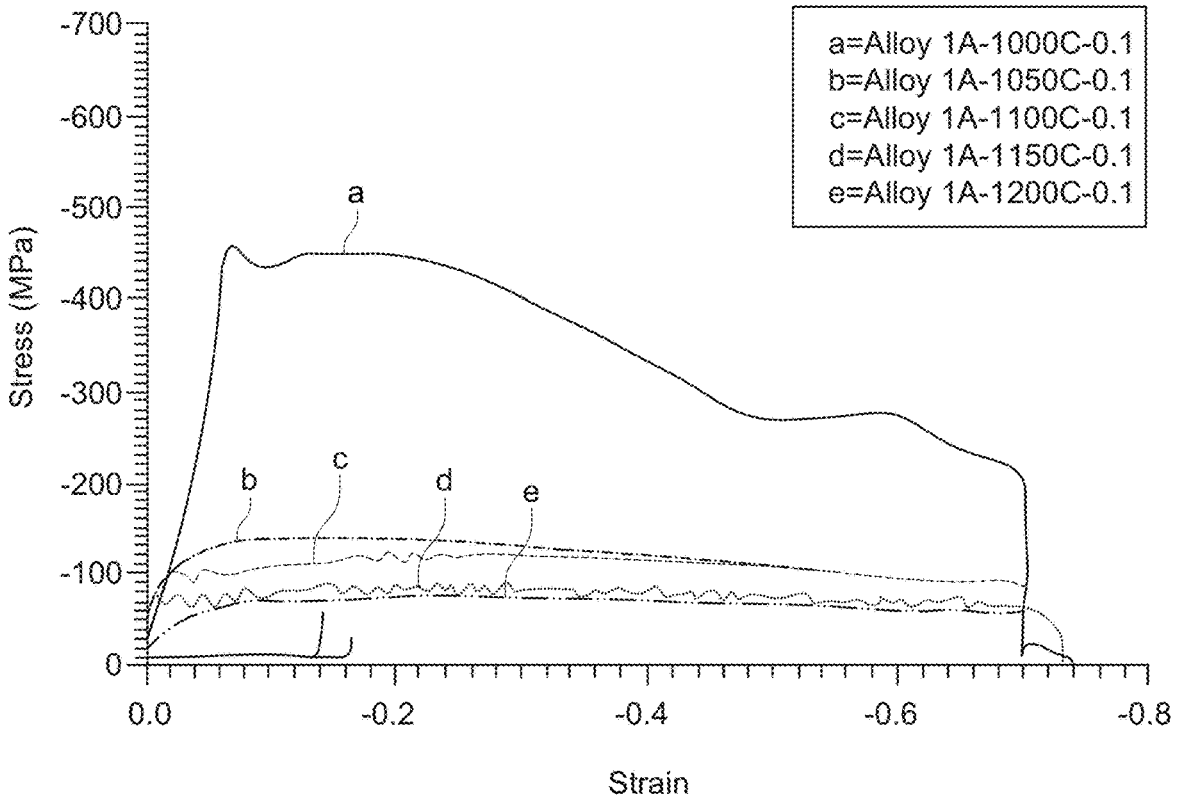
FIGS. 20A and 20B are true stress true strain plots at different temperatures showing results obtained at strain rates of 0.1/s (FIG. 20A) and 1.0/s (FIG. 20B) for solution-treated embodiments of Alloy 1A.
Figure 20B:
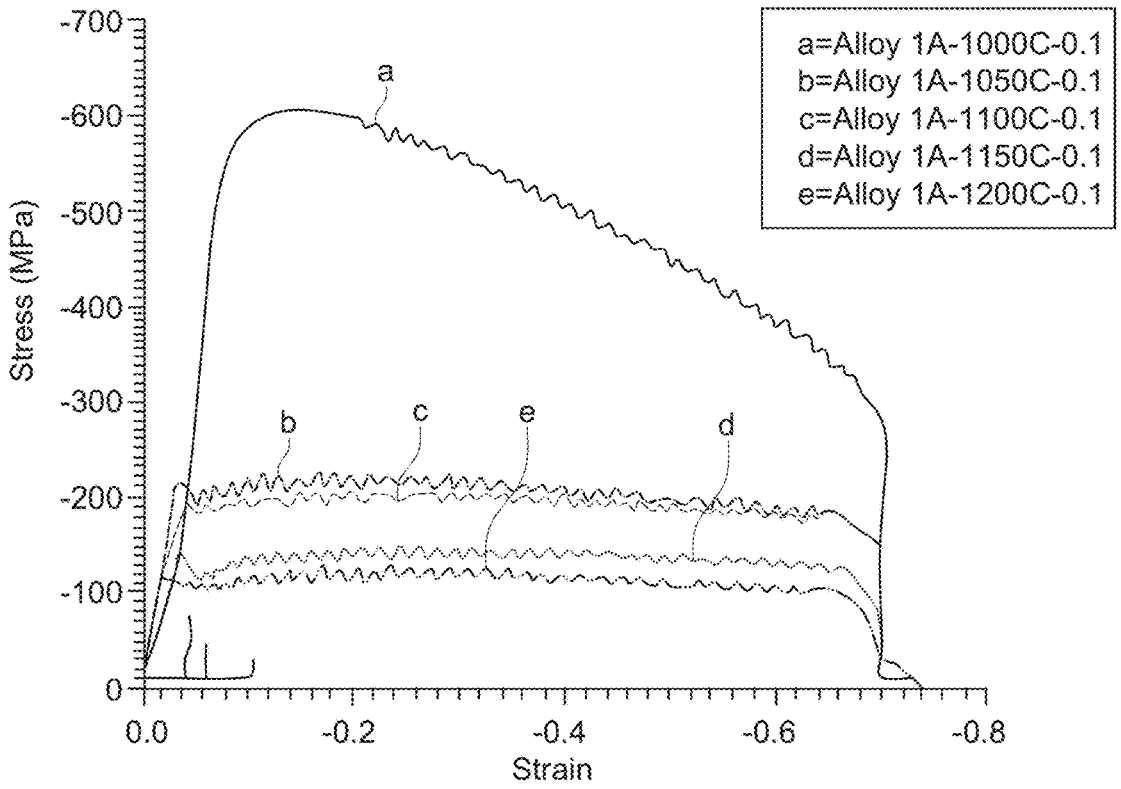
Figure 21A:
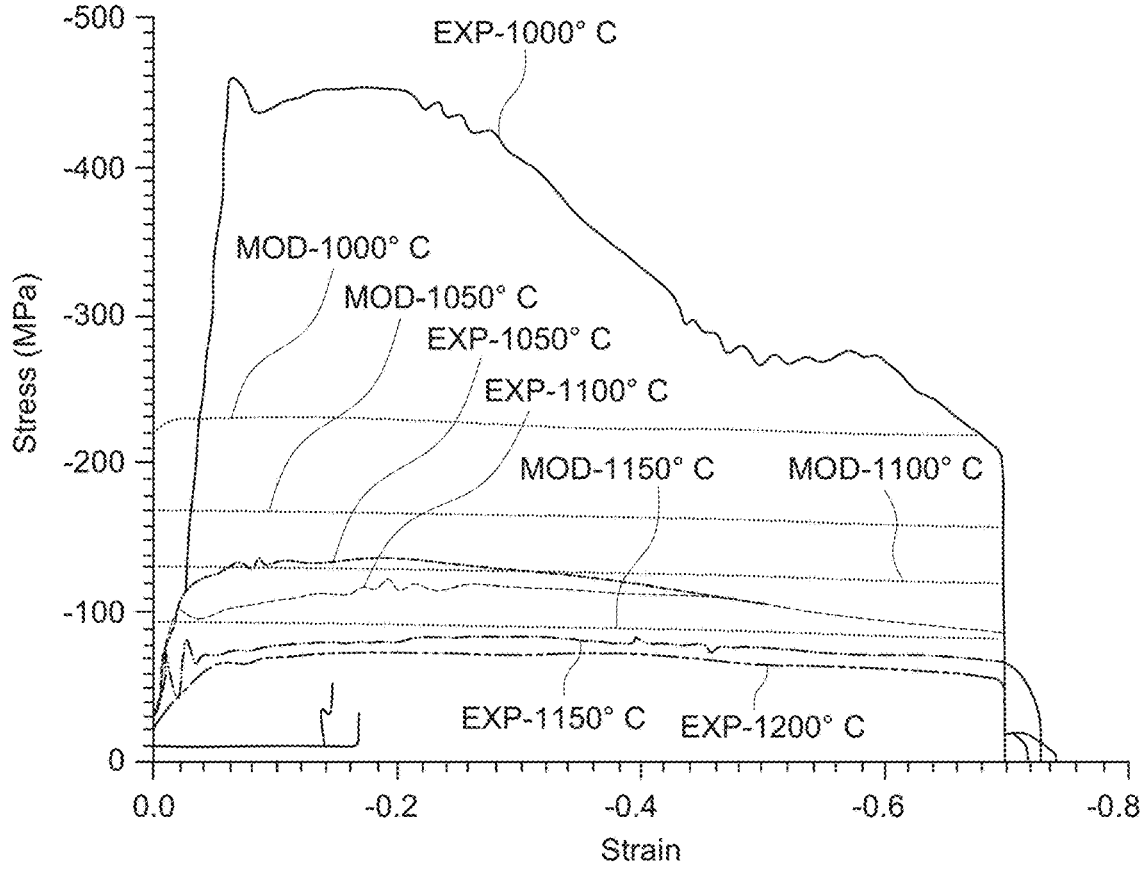
FIGS. 21A and 21B show true stress true strain plots as compared with calculated flow stress results from JmatPro 6.0® at different temperatures and using strain rates of 0.1/s (FIG. 21A) and 1.0/s (FIG. 21B) for solution-treated embodiments of Alloy 1A.
Figure 21B:
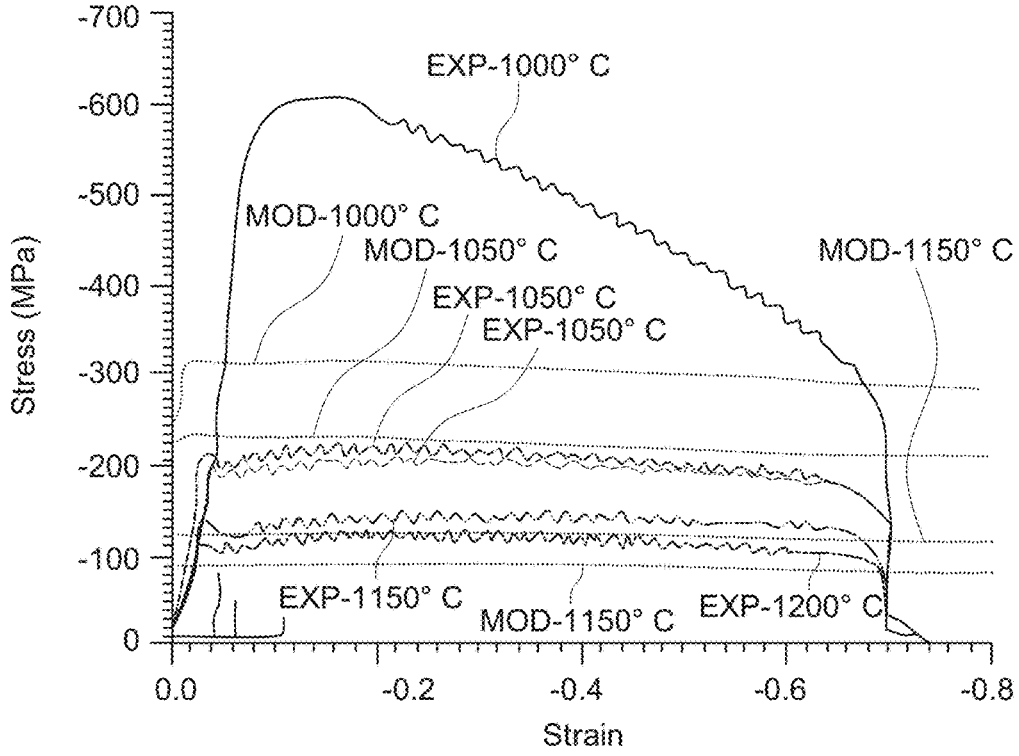
Figure 22A:
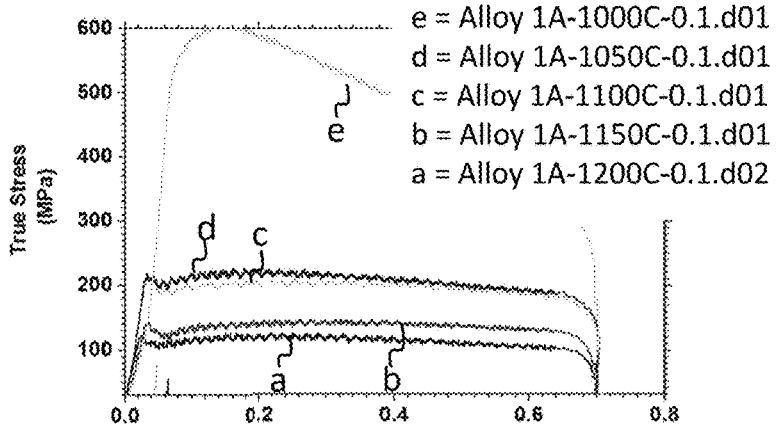
FIGS. 22A-22I are true stress—true strain curves for all temperatures and strain rates for Alloy 1A, Haynes 214, and Inconel 740H.
Figure 22B:
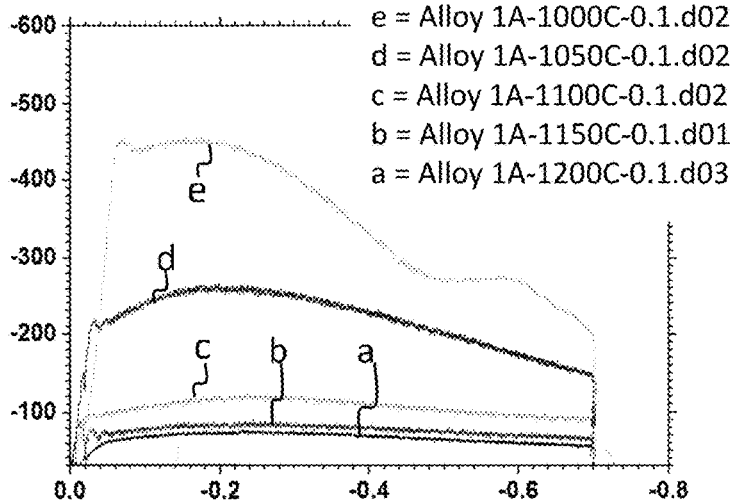
Figure 22C:
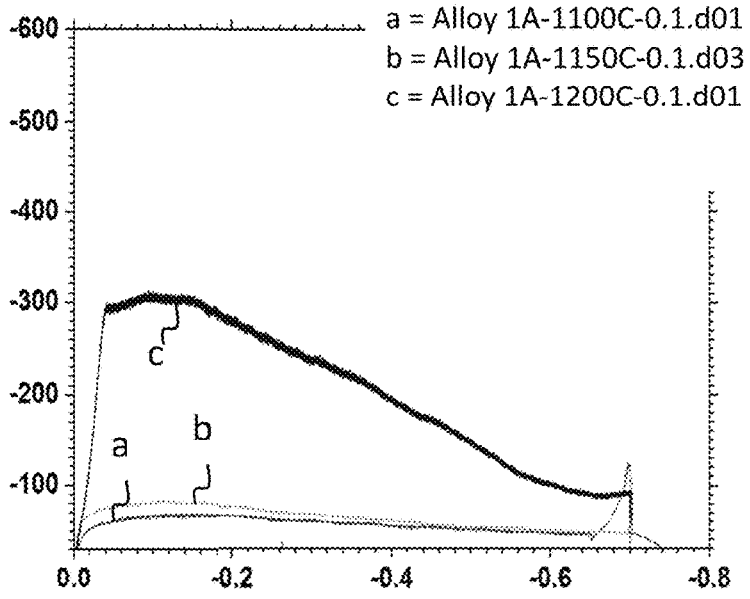
Figure 22D:
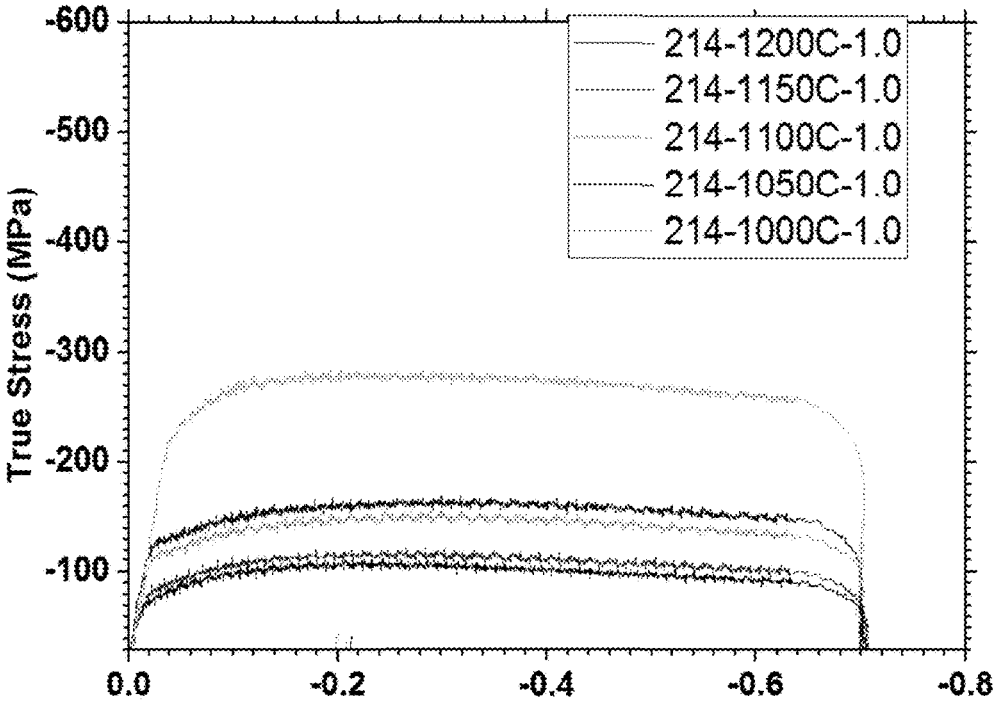
Figure 22E:
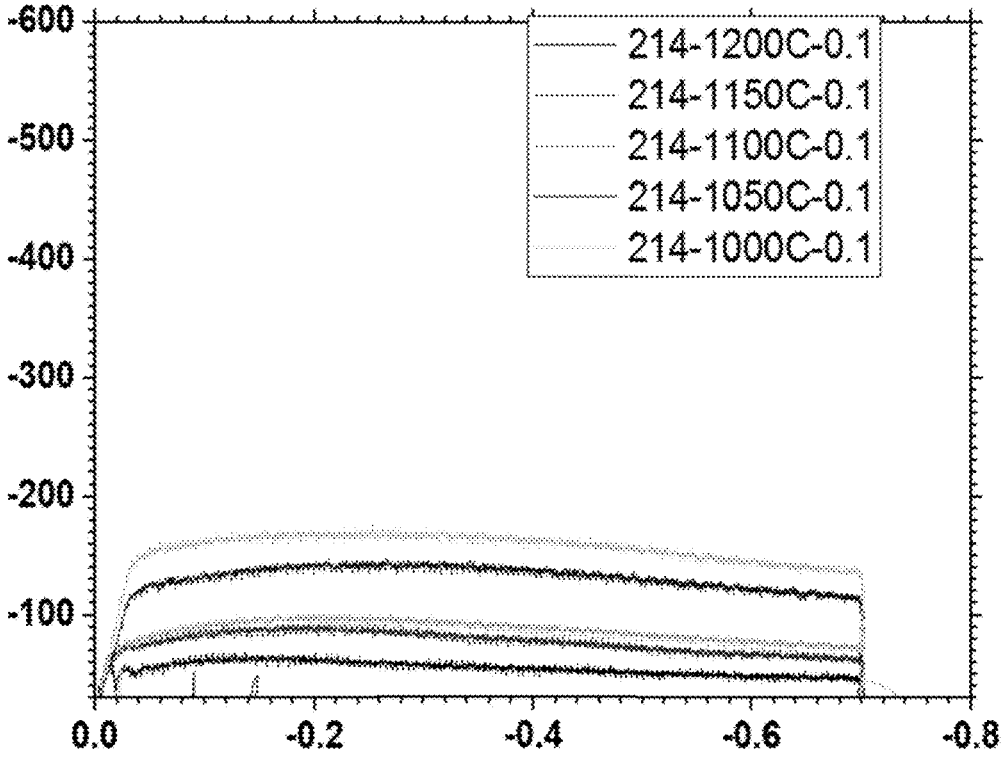
Figure 22F:
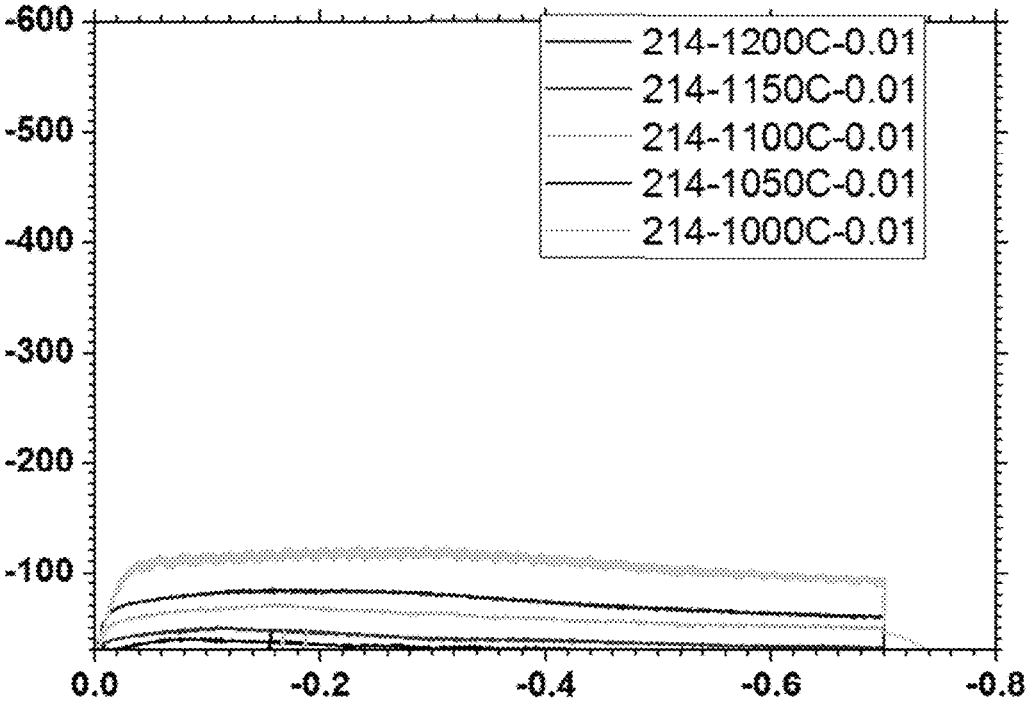
Figure 22G:
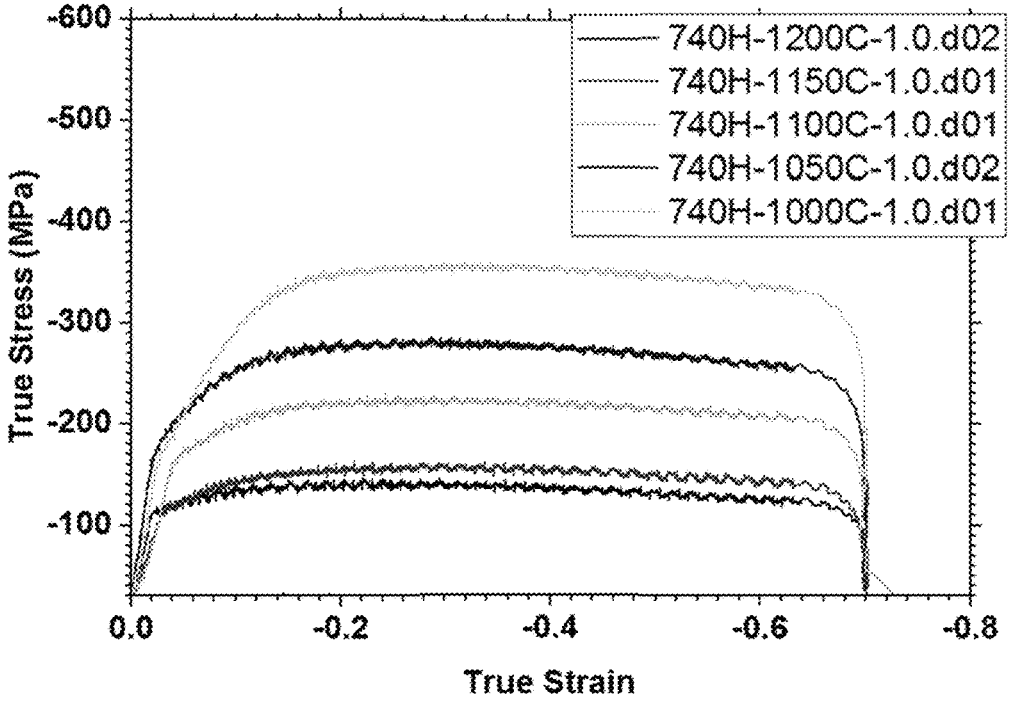
Figure 22H:
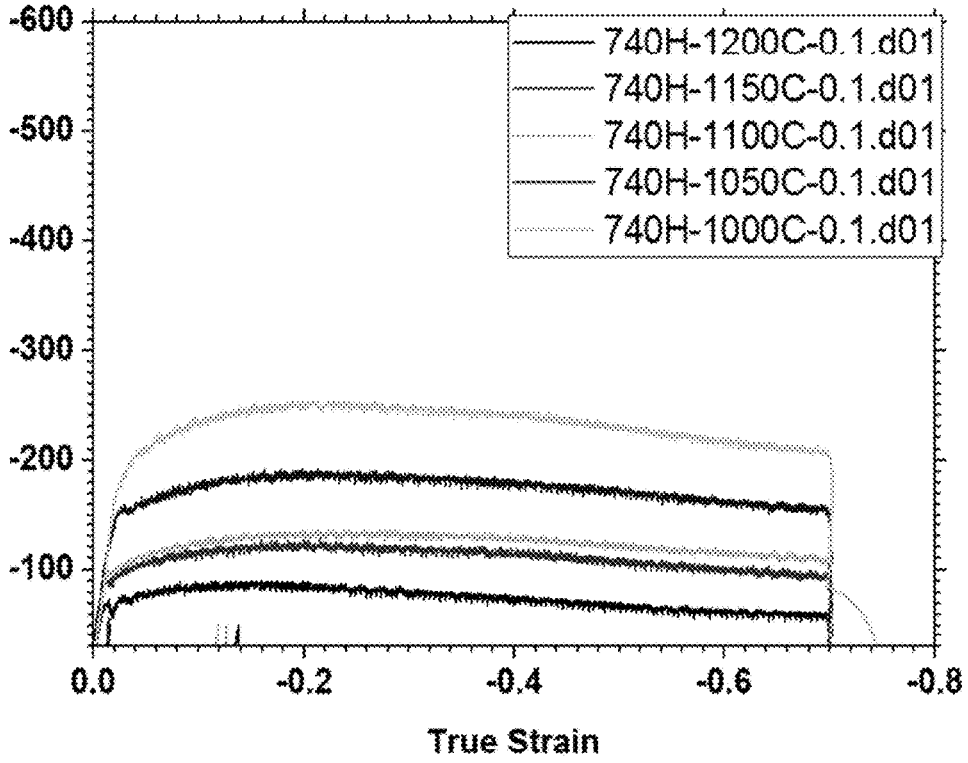
Figure 22I:
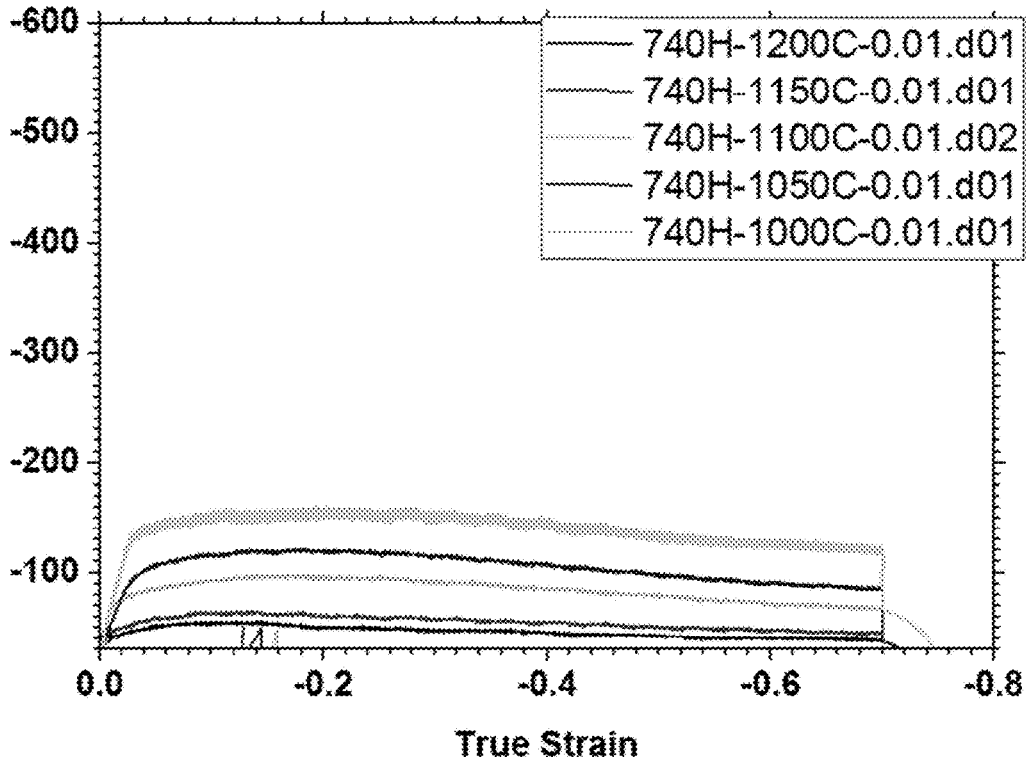

The influence of the different strain rates of 0.1/s and 1.0/s is shown in FIGS. 20A and 20B, respectively. The stress-strain curves show generally comparable strain hardening behavior between the two strain rates. Notable differences are the overall flow stress values, which are in all cases higher for the faster strain rate of 1.0/s. In specific, below 1000° C., where the flow-stress values are twice as high as at the lower strain rate. At the same time, the relative difference between the flow-stress levels for the different temperatures appeared the same for both strain rates. Further, it is noteworthy, that the sample at 1000° C. for the strain rate of 1.0/s did not show fracturing during the upset or in the stress-strain curve, but the sample did show circumferential cracking after cooling. Comparison with thermodynamic modeling data from JmatPro 6.0® for flow stress, based on calculations for the solution-treated matrix grain size, is presented in FIGS. 21A and 21B. Generally, for both strain rates, there is a large deviation from the calculated to the experimental results, especially for temperatures below 1050° C. At even lower temperatures, the agreement between the datasets improves, while the calculated results are still not accurately reflecting the different strain hardening behaviors or events like dynamic recrystallization.

Additionally, the performance of Alloy 1A was compared against that of Haynes 214 and Inconel 740H. Using different sample designs, the cracking susceptibility and cracking severity during hot working were analyzed specifically, along with the conditions under which it can occur. The results are shown in FIGS. 22A-22I. Alloy 1A performed well against the commercial alloys, showing a considerable amount of high-temperature strength, comparable with the γ'-strengthened alloy 740H. While Alloy 1A shows very high flow stress values at the peak temperature of 1200° C., this is of limited concern as most hot-processing for Ni-based alloys takes place at 1000° C.-1150° C.

Example 4

Figure 23:
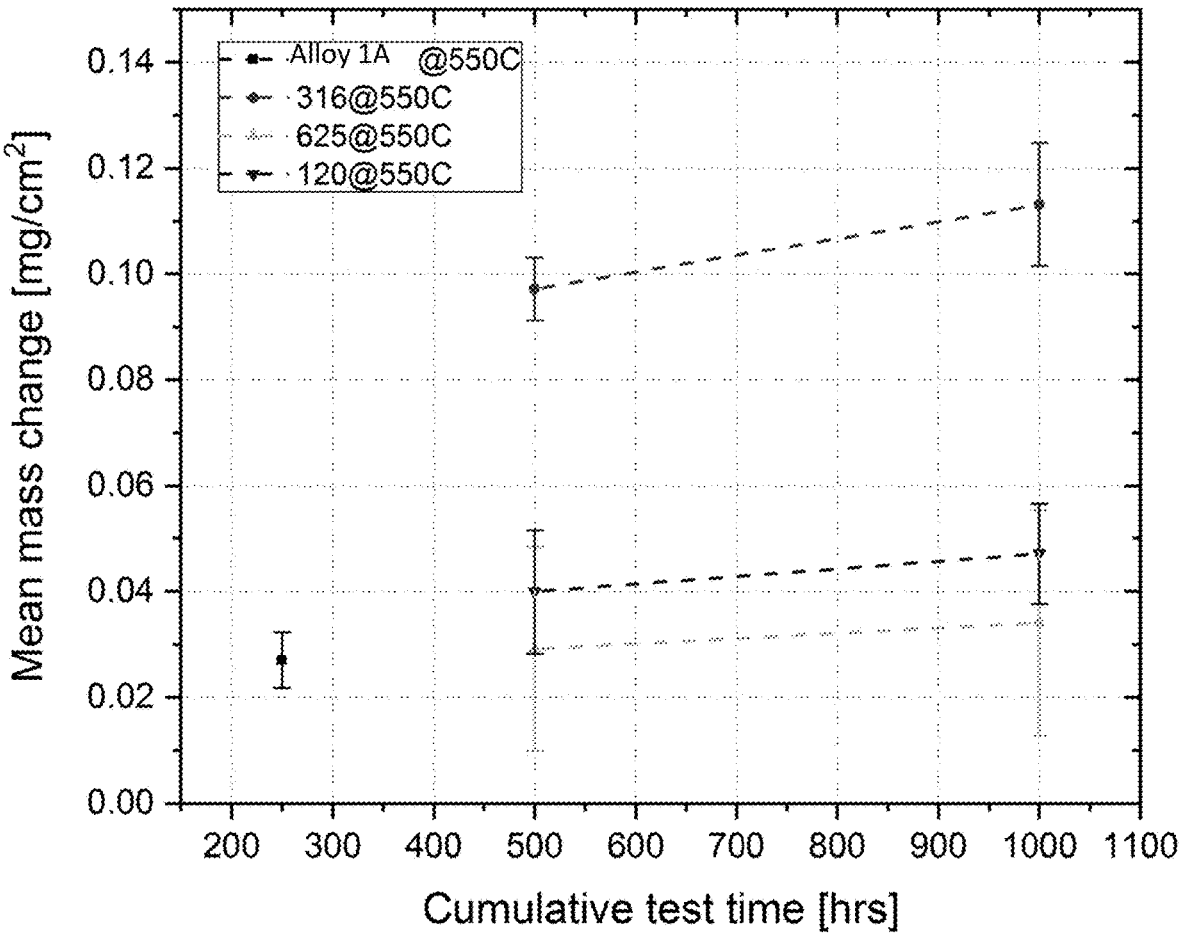
FIG. 23 is a graph showing mass change results after $sCO_2$ exposure at 550° C. at 20 MPa for Alloy 1A, stainless steel 316, Inconel 625, and Inconel 120.

In this example, exposures in $sCO_2$ were performed in an autoclave for the Alloy 1A, as well as three commercial alloys (namely, stainless steel 316, Inconel 625, and HR120). Exposure times of 250 and 750 hrs were used for Alloy 1A, and up to 1000 hours for the commercial alloys, at a constant temperature of 550° C. The results of these samples are shown in FIG. 23. The data suggest that the mass change for Alloy 1A is at least on the same order as extrapolated values for the Inconel 625, and HR120 alloys, if not better.

Example 5

In this example, $sCO_2$ testing at temperatures up to 700° C. and exposure times of 1500 hours is assessed to evaluate the performance at the upper range for application under conditions for advanced ultra-supercritical systems (or A-USC), such as heat-exchanger systems for power plants, including nuclear, fossil, solar or geothermal power plants.

Generally, A-USC conditions include temperatures of up to 760° C., and exhibition of a creep rupture strength of at least 100 MPa at 100,000 hours $sCO_2$ exposure.

As certain alloy embodiments of the present disclosure are designed for use in pipe and pressure systems, official code requirements demand materials to meet mechanical specifications for these environments. Therefore, more mechanical results are generated to provide sufficient, statistically relevant data about different alloy embodiments. Such information allows one to determine where areas of stronger and weaker performance lie, and to specifically address them by adjusting the respective underlying metallurgical aspects, such as composition, heat-treatment and microstructure. Additionally, large-scale production of certain alloys (e.g., between 200 and 500 lbs melts) is conducted and resulting alloys subjected to refinement by multiple re-melting steps. The produced ingot are then forged and hot-rolled.

In view of the many possible embodiments to which the principles of the present disclosure may be applied, it should be recognized that the illustrated embodiments are only preferred examples and should not be taken as limiting the scope of the present disclosure. Rather, the scope is defined by the following claims. We therefore claim as our invention all that comes within the scope and spirit of these claims.

We claim:

1. A method for making an alloy that comprises the following components: greater than 0 wt % to 80% nickel; greater than 0 wt % to 30% chromium; greater than 0 wt % to 25% cobalt; greater than 0 wt % to 10% aluminum; and greater than 0 wt % to 1% carbon; and wherein the alloy does not comprise the following components: (i) 16 wt % Cr, 4.5 wt % Al, 3.5 wt % Fe, 0.05 wt % C, 0.01 wt % B, 0.2 wt % Mn, 0.1 wt % Si, 0.01 wt % Y, 0.02 wt % Zr, and a balance wt % made up of Ni and trace impurities; (ii) 22 wt % Cr, 5 wt % Co, 2 wt % Mo, 14 wt % W, 0.3 wt % Al, 3 wt % Fe, 0.1 wt % C, 0.015 wt % B, 0.5 wt % Mn, 0.4 wt % Si, 0.02 wt % La, and a balance wt % made up of Ni and trace impurities; (iii) 25 wt % Cr, 20 wt % Co, 0.5 wt % Mo, 2 wt % Nb, 1.8 wt % Ti, 0.9 wt % Al, 0.7 wt % Fe, 0.03 wt % C, 0.3 wt % Mn, 0.5 wt % Si, and a balance wt % made of Ni and trace impurities; (iv) 20 wt % Cr, 8 wt % Mo, 3.15 wt % Nb, and a balance wt % made up of Ni and trace impurities; (v) 23 wt % Cr, 1 wt % Co, 10 wt % Mo, 4.15 wt % Nb, 0.4 wt % Ti, 0.4 wt % Al, 5 wt % Fe, 0.1 wt % C, 0.5 wt % Mn, 0.5 wt % Si, 0.015 wt % P, 015 wt % S, and a balance wt % made of Ni and trace impurities; or (vi) 25 wt % Cr, 3 wt % or less Co, 2.5 wt % or less Mo, 0.7 wt % Nb, 0.1 wt % Al, 37 wt % Ni, 0.03 wt % C, 0.7 wt % Mn, 0.6 wt % Si, 0.2 wt % N, 0.05 wt % C, 0.004 wt % B, and a balance wt % made of Fe and trace impurities, the method comprising:

determining a set of properties for the alloy to configure it for use with a supercritical fluid;

determining an initial composition of constituent alloy elements of the alloy;

calculating the set of properties for the initial composition of the alloy using thermodynamic and kinetic analysis; and fabricating the alloy.

2. The method of claim 1, wherein the set of properties of the alloy comprises a partition coefficient of the alloy, a yield strength of the alloy, a tensile strength of the alloy, a creep rupture stability of the alloy, or any combination thereof.

3. The method of claim 1, further comprising determining at least one subsequent treatment to which the alloy can be subject to improve the set of properties.

4. The method of claim 3, wherein the at least one subsequent treatment comprises solution-treating the alloy, homogenizing the alloy, aging the alloy, strain-hardening the alloy, forming a protective coating on the alloy, or any combination thereof.

5. The method of claim 3, further comprising exposing the alloy to the at least one subsequent treatment.

6. The method of claim 1, further comprising exposing the alloy to a supercritical fluid and measuring corrosion resistance of the alloy.

7. The method of claim 6, wherein measuring corrosion resistance of the alloy comprises measuring a change in mass following exposure of the alloy to the supercritical fluid.

8. A method for fabricating a nickel-based alloy, comprising:

determining a set of properties for the nickel-based alloy;

determining an initial composition of constituent alloy elements of the nickel-based alloy;

calculating the set of properties selected from a partition coefficient of the alloy, a yield strength of the alloy, a tensile strength of the alloy, a creep rupture stability of the alloy, or any combination thereof for the initial composition of the nickel-based alloy using thermodynamic analysis, a kinetic analysis, or a combination thereof;

fabricating the nickel-based alloy;

subjecting the nickel-based alloy to at least one subsequent treatment selected from homogenization, aging, strain-hardening, solution-treating, protective coating formation, or combinations thereof at a particular temperature, treatment time period, applied stress, or combinations thereof;

analyzing a microstructure of the nickel-based alloy using scanning electron microscopy (SEM), scanning electron microscopy-back scattered electron imaging (SEM-BSE), secondary-electron imaging (SE), transmission electron microscopy (TEM), selected area diffraction (SAED), high resolution X-ray diffraction (XRD), energy-dispersive X-ray spectroscopy (EDX), electron energy loss spectroscopy (EELS), or any combination thereof;

analyzing at least one mechanical property of the nickel-based alloy; and exposing the nickel-based alloy to a supercritical fluid;

wherein calculating the set of properties using thermodynamics analysis, kinetics analysis, or combinations thereof is conducted utilizing the Scheil-Gulliver equation and utilizing computer-aided software to generate a solidification plot, an equilibrium plot, a coarsening plot, a stress-strain plot, a partition coefficient, a simulated homogenization treatment, a simulated binding energy, or combinations thereof.

* * * * *